US010614730B2

(12) United States Patent
Maltas et al.

(10) Patent No.: US 10,614,730 B2
(45) Date of Patent: Apr. 7, 2020

(54) LABELING SLEEVE ASSEMBLY, AND METHODS OF MANUFACTURING AND USE THEREOF

(71) Applicant: Bedford Industries, Inc., Worthington, MN (US)

(72) Inventors: Jeffrey S. Maltas, Sibley, IA (US); Trevor Wintz, Round Lake, MN (US); David Schiller, Sioux Falls, SD (US); Colin M. O'Donnell, Worthington, MN (US)

(73) Assignee: Bedford Industries, Inc., Worthington, MN (US)

( * ) Notice: Subject to any disclaimer, the term of this patent is extended or adjusted under 35 U.S.C. 154(b) by 133 days.

(21) Appl. No.: 15/816,019

(22) Filed: Nov. 17, 2017

(65) Prior Publication Data

US 2018/0075783 A1 Mar. 15, 2018

Related U.S. Application Data

(63) Continuation of application No. 14/917,437, filed as application No. PCT/US2014/052680 on Aug. 26, 2014, now abandoned.

(60) Provisional application No. 61/911,065, filed on Dec. 3, 2013, provisional application No. 61/877,498, filed on Sep. 13, 2013.

(51) Int. Cl.

| | |
|---|---|
| ***G09F 3/04*** | (2006.01) |
| ***G09F 3/10*** | (2006.01) |
| ***G09F 3/14*** | (2006.01) |
| *G09F 3/02* | (2006.01) |

(52) U.S. Cl.

CPC ..... *G09F 3/04* (2013.01); *G09F 3/10* (2013.01); *G09F 3/14* (2013.01); *G09F 2003/0251* (2013.01)

(58) Field of Classification Search

CPC ... G09F 3/14; G09F 3/04; G09F 3/005; G09F 3/18; G09F 3/00; G09F 3/10; G09F 3/02; G09F 2003/023; G09F 3/0288; G09F 2003/0264; G09F 2003/0251; B65D 63/10; B65D 63/1009; C09J 7/02

See application file for complete search history.

(56) References Cited

U.S. PATENT DOCUMENTS

| | | | | |
|---|---|---|---|---|
| 2,516,292 A * | 7/1950 | Bennett | B65D 63/10 | 206/497 |
| 3,930,506 A * | 1/1976 | Overend | A61B 17/1322 | 606/203 |
| 5,733,652 A * | 3/1998 | Stowman | B65D 63/1009 | 156/60 |

OTHER PUBLICATIONS

Examination report from corresponding European Patent Application No. 14 761 528.0, dated May 23, 2019.

(Continued)

*Primary Examiner* — Cassandra Davis

(74) *Attorney, Agent, or Firm* — Mai-Tram D. Lauer; Westman, Champlin & Koehler, P.A.

(57) ABSTRACT

A labeling sleeve assembly includes a label strap having a first end segment and a second end segment, where the label strap is configured to be formed into a loop, and an elastic band. The elastic band includes a first anchor region configured to bond to the first end segment of the label strap while the label strap is formed into the loop, a second anchor region configured to bond to the second end segment of the label strap while the label strap is formed into the loop, and a bridging segment derived from an elastic layer, where the bridging segment connects the first anchor region and the second anchor region.

14 Claims, 31 Drawing Sheets

(56) References Cited

OTHER PUBLICATIONS

First Official Action from corresponding Mexican Application No. MX/a/2016/003125, dated Jul. 22, 2019; with English translation from Mexican Associate dated Aug. 13, 2019.
First Examination Report from corresponding New Zealand Application No. 717635, dated Sep. 9, 2019.
Mexican Office Action for corresponding Patent Application No. MX/a/2016/003125, dated Nov. 6, 2019.

* cited by examiner

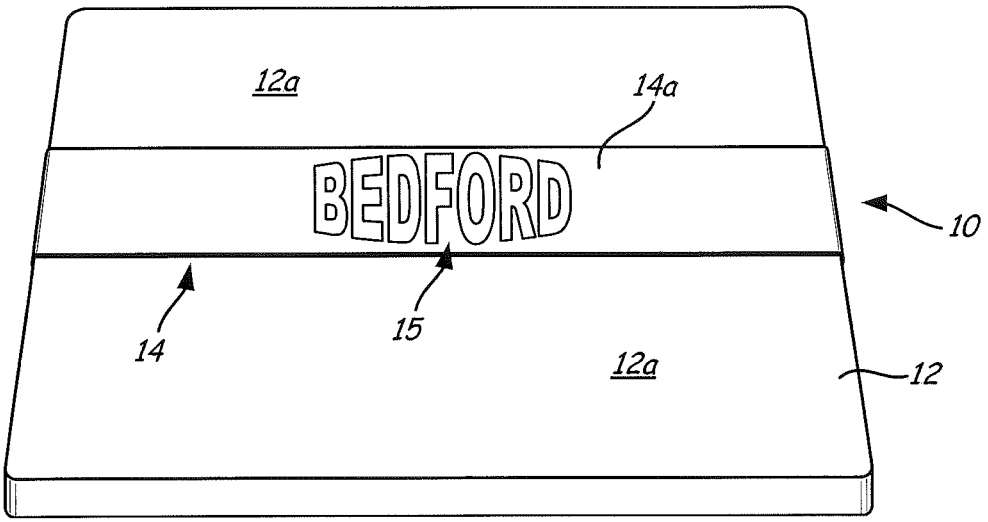
FIG. 1A
FIG. 1B
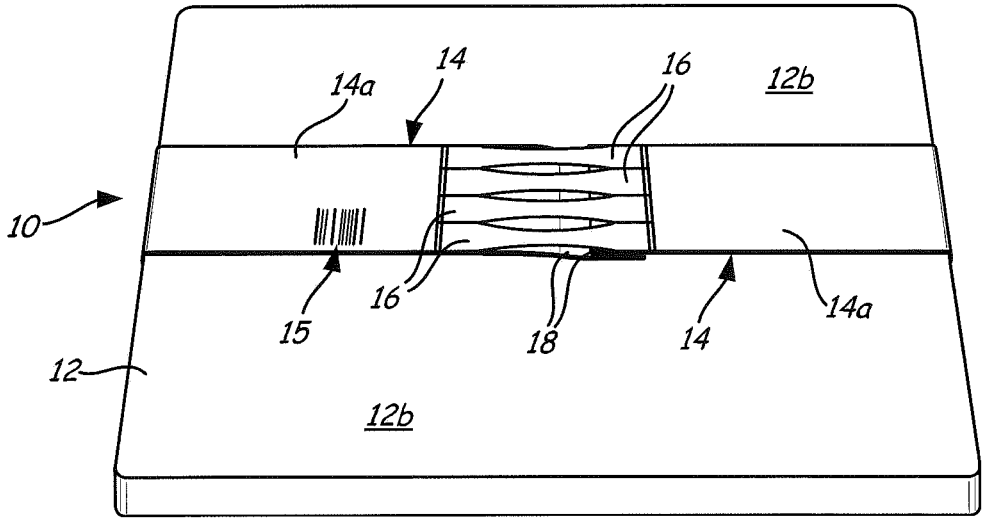

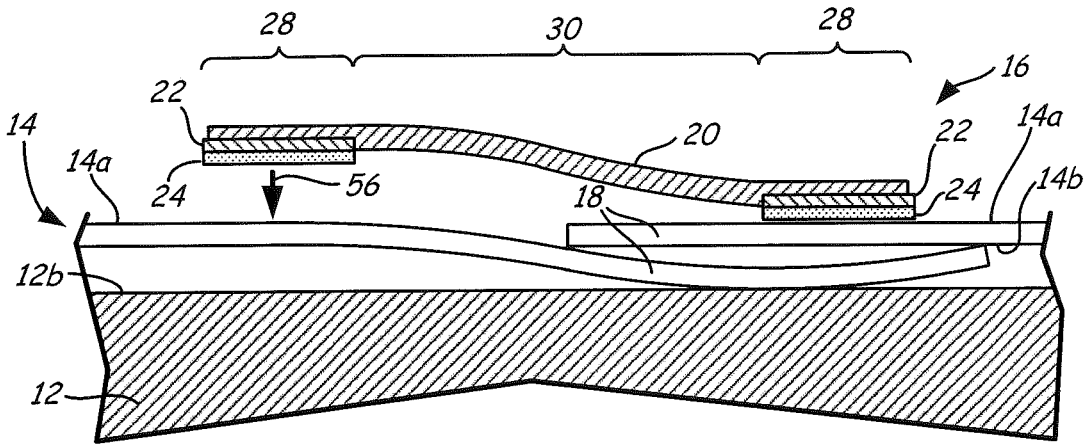
FIG. 4F
FIG. 5A
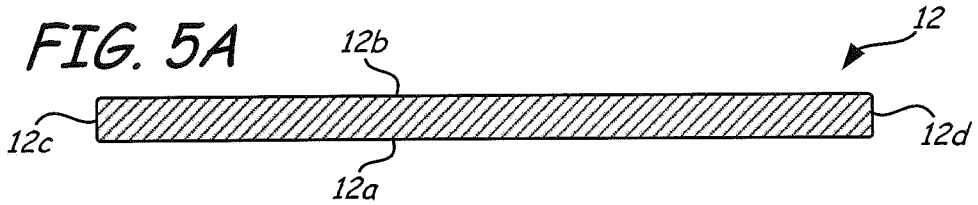
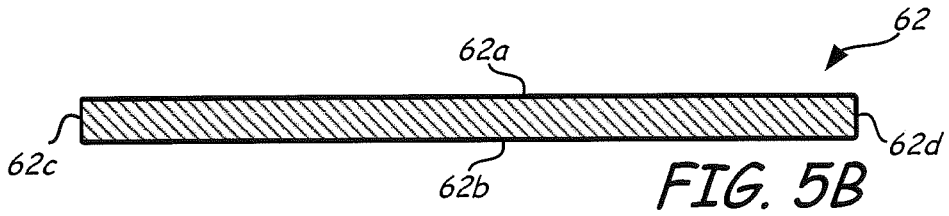
FIG. 5B
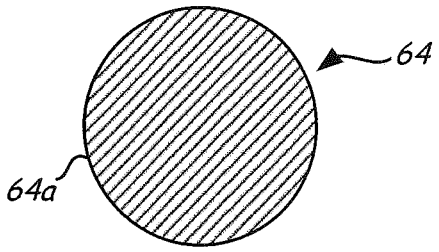
FIG. 6A
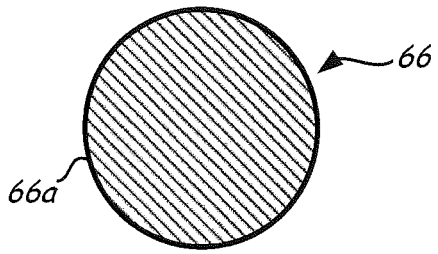
FIG. 6B FIG. 18A
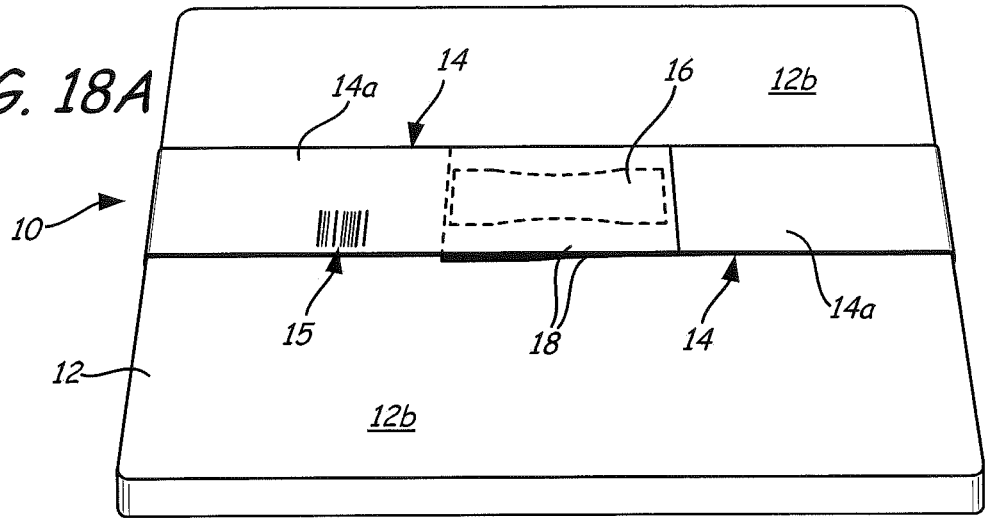
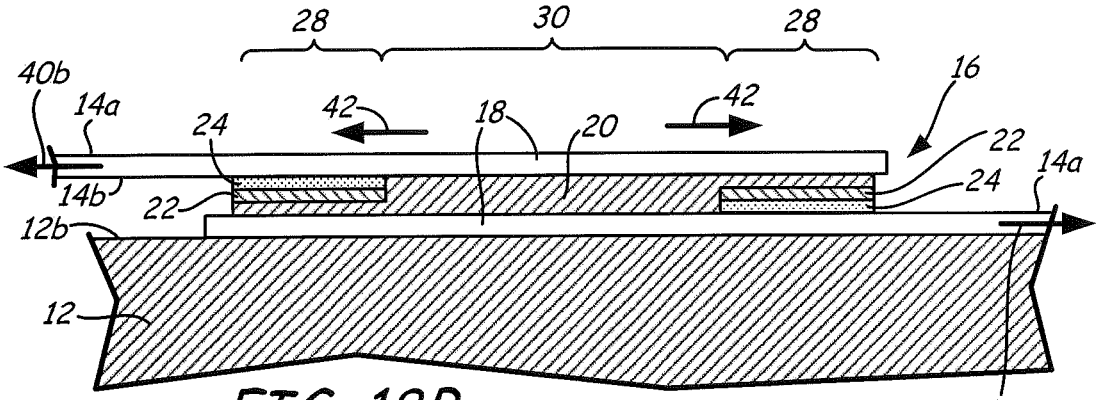
FIG. 18B
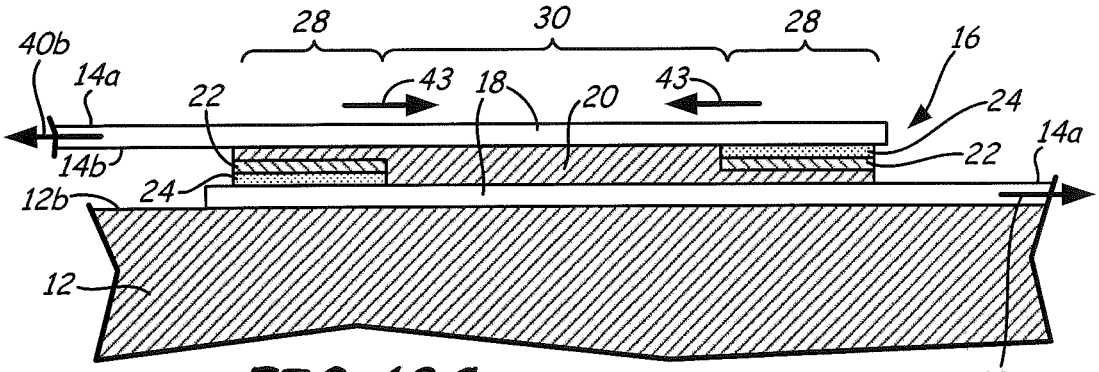
FIG. 18C

LABELING SLEEVE ASSEMBLY, AND METHODS OF MANUFACTURING AND USE THEREOF

CROSS-REFERENCE TO RELATED APPLICATION(S)

This Application is a continuation of U.S. patent application Ser. No. 14/917,437, filed on Mar. 8, 2016, which is a 371 National Stage Application of International Application No. PCT/US2014/052680, filed on Aug. 26, 2014, published as International Publication No. WO 2015/038326 A1, which claims priority to U.S. Provisional Patent Application No. 61/911,065, filed Dec. 3, 2013, and U.S. Provisional Patent Application No. 61/877,498, filed on Sep. 13, 2013.

BACKGROUND

The present disclosure relates to labels for use with various articles (e.g., commercial products and other items). In particular, the present disclosure relates to sleeve-based labels for use with articles, and methods of manufacturing and use thereof.

It is known to use an elastic material to affix a label or tag to an item such as a product package, bottle or the like. In those instances where the item being tagged has an irregular shape or if it is desired to bind several items together, the elastic material is desirably resilient enough to be placed around the item(s) (e.g., a watermelon, bunch of asparagus, large container or other item) yet maintain its labeling function without distortion to the label. In many cases, the label may include not only human detectable indicia, but also machine detectable indicia (e.g., a UPC bar code). In addition, the label and its elastic fastening component must be strong enough to stand the rigors of transport and handling, and retain itself in position on the item without damage thereto.

SUMMARY

An aspect of the present disclosure is directed to a labeling sleeve assembly that includes a label strap having a first end segment and a second end segment, where the label strap is configured to be formed into a loop, and an elastic band. The elastic band includes a first anchor region configured to bond to the first end segment of the label strap while the label strap is formed into the loop, a second anchor region configured to bond to the second end segment of the label strap while the label strap is formed into the loop, and a bridging segment derived from an elastic layer, where the bridging segment connects the first anchor region and the second anchor region.

Another aspect of the present disclosure is directed to an elastic band for use with a label strap having first and second end segments, and which is formable into a loop. The elastic band includes a first anchor region, a second anchor region, and an elastic layer. The first anchor region includes a first adhesive layer having a first side and a second side, the first side of the first adhesive layer being configured to adhere to the first end segment of the label strap, and a first support layer disposed against the second side of the first adhesive layer. The second anchor region includes a second adhesive layer having a first side and a second side, the first side of the second adhesive layer being configured to adhere to the second end segment of the label strap, and a second support layer disposed against the second side of the second adhesive layer. The elastic layer includes a first portion disposed against the first support layer opposite of the first adhesive layer, a second portion disposed against the second support layer opposite of the second adhesive layer, and a bridging segment disposed between the first and second portions of the elastic layer to connect the first anchor region and the second anchor region.

Another aspect of the present disclosure is directed to a method for securing a labeling sleeve assembly to one or more articles at an intended placement location. The method includes forming a label strap having first and second end segments into a loop, where the loop has an interior perimeter length that is shorter than a length of a footprint perimeter of the article(s) at the intended placement location, and adhering a first anchor region of an elastic band to the first end segment of the label strap while the label strap is formed into the loop. The method also includes adhering a second anchor region of the elastic band to the second end segment of the label strap while the label strap is formed into the loop, where the first and second anchor regions of the elastic band are connected with an elastic bridging segment of the elastic band, thereby providing the labeling sleeve assembly. The method further includes expanding the labeling sleeve assembly to increase the interior perimeter length of the loop, where the expanding stretches the elastic bridging segment of the elastic band, positioning the expanded labeling sleeve assembly around the article(s) to the intended placement location, and releasing the positioned labeling sleeve assembly such that the stretched elastic bridging segment partially contracts to a relaxed state, thereby holding the labeling sleeve assembly around the article(s) under elastic tension.

Another aspect of the present disclosure is directed to a method for securing a labeling sleeve assembly to one or more articles at an intended placement location, which includes forming a label strap having first and second end segments into a loop around the article(s) at the intended placement location, and adhering a first anchor region of an elastic band to the first end segment of the label strap while the label strap is formed into the loop, where the elastic band also includes a second anchor region and an elastic bridging segment that connects the first and second anchor regions. The method also includes stretching the elastic band to an expanded state while the first anchor region is adhered to the first end segment, but while the second anchor region remains apart from the second end segment of the label strap. The method further includes adhering the second anchor region of the stretched elastic band to the second end segment of the label strap, thereby providing the labeling sleeve assembly, and releasing the stretched elastic band such that the elastic bridging segment partially contracts to a relaxed state, thereby holding the labeling sleeve assembly around the article(s) under elastic tension.

Another aspect of the present disclosure is directed to a supply of multiple elastic bands. The supply includes a pair of adhesive web strips, a pair of support web strips disposed against the pair of adhesive web strips, and an elastic web disposed against the pair of support web strips, thereby defining a pair of web-based anchor strips connected by a web-based bridging strip of the elastic web. The adhesive web strips, the support web strips, and the elastic web are scored to designate individual elastic bands.

Another aspect of the present disclosure is directed to a labeling sleeve assembly that includes a label strap having a first end segment and a second end segment, wherein the label strap is configured to be formed into a loop, and an elastic band. The elastic band includes a first anchor region bonded to the first end segment of the label strap, a second anchor region configured to bond to the second end segment of the label strap while the label strap is formed into the loop, and a bridging segment derived from an elastic layer, where the bridging segment connects the first anchor region and the second anchor region.

Another aspect of the present disclosure is directed to a labeling sleeve assembly that includes a label strap having a first end segment and a second end segment, where the label strap is configured to be formed into a loop, and an elastic band. The elastic band includes a front-facing anchor region configured to bond to the first end segment of the label strap while the label strap is formed into the loop, a rear-facing anchor region configured to bond to the second end segment of the label strap while the label strap is formed into the loop, and a bridging segment derived from an elastic layer, where the bridging segment connects the front-facing anchor region and the rear-facing anchor region.

This summary is provided to introduce a selection of one or more concepts in a simplified form that are further described below in the Detailed Description. This summary is not intended to identify key features or essential features of the claimed subject matter, is not intended to describe each disclosed embodiment or every implementation of the claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

Definitions

Unless otherwise specified, the following terms as used herein have the meanings provided below:

The terms "at least one" and "one or more of" an element are used interchangeably, and have the same meaning that includes a single element and a plurality of the elements, and may also be represented by the suffix "(s)" at the end of the element. For example, "at least one article", "one or more articles", and "article(s)" may be used interchangeably and have the same meaning.

The terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the present disclosure.

The terms "about" and "substantially" are used herein with respect to measurable values and ranges due to expected variations known to those skilled in the art (e.g., limitations and variabilities in measurements).

The terms "loop" and "footprint perimeter" are explained below (see e.g., FIGS. 5A-8C).

BRIEF DESCRIPTION OF THE DRAWINGS

The disclosed subject matter will be further explained with reference to the attached figures, wherein like structure is referred to by like reference numerals throughout the several views.

FIG. 1A is a front perspective view of a labeling sleeve assembly of the present disclosure having a label strap secured around an article.

FIG. 1B is a rear perspective view of the labeling sleeve assembly, illustrating multiple elastic bands of the labeling sleeve assembly, which hold the label strap secured around the article.

FIGS. 4A-4F are schematic illustrations of a second technique for forming and securing the labeling sleeve assembly around an article.

FIGS. 5A and 5B illustrate a technique for determining a footprint perimeter of a rectangular article.

FIGS. 6A and 6B illustrate a technique for determining a footprint perimeter of a cylindrical article.

FIG. 18A is a rear perspective view of the labeling sleeve assembly with the elastic band shown in FIGS. 17A-17C holding the label strap secured around the article.

FIG. 18B is a side view of the elastic band shown in FIGS. 17A-17C being used to securing the label strap assembly around an article in a preferred example.

FIG. 18C is a side view of the elastic band shown in FIGS. 17A-17C being used to securing the label strap assembly around an article in a comparative example.

Figure 2A:
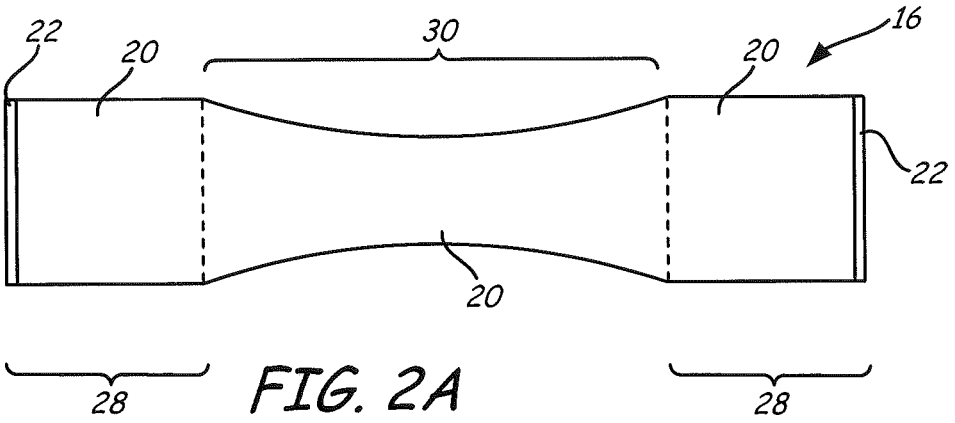
FIG. 2A is a front view of an example elastic band of the labeling sleeve assembly, prior to being affixed to the label strap.

Although the above-identified figures set forth various features of the disclosed subject matter, other combinations of features are also contemplated, as noted in the disclosure. In all cases, this disclosure presents the disclosed subject matter by way of representation and not limitation. It should be understood that numerous other modifications and feature combinations can be devised by those skilled in the art which fall within the scope and spirit of the principles of this disclosure. It should be understood that the figures have not been drawn to scale as it has been necessary to enlarge certain portions for clarity of illustration.

DETAILED DESCRIPTION

The present disclosure is directed to a unique labeling sleeve assembly that may be secured around an article (e.g., a commercial product or other item) under elastic tension. As discussed below, the labeling sleeve assembly includes a label strap that is formable into a loop (as explained below), and one or more elastic bands configured to hold the label strap as a loop around an article under elastic tension. For example, as shown in FIG. 1A, labeling sleeve assembly 10 of the present disclosure may be secured snugly around board 12, where board 12 is an example article (e.g., a cutting board) that labeling sleeve assembly 10 may be used with. However, labeling sleeve assembly 10 may be used with a variety of different articles, such as commercial products and other items.

Additionally, labeling sleeve assembly 10 may be secured around a bundle of multiple articles, such as bundles of agricultural produce, writing utensils, stackable items (e.g., notepads, boards, books, etc. . . . ), and the like. For ease of discussion, the following disclosure focuses primarily on the use of labeling sleeve assembly 10 with a single article (e.g., board 12). However, it is understood that labeling sleeve assembly 10 may also be secured around a bundle of multiple articles in the same manner.

As shown, labeling sleeve assembly 10 includes label strap 14 secured as a loop around board 12, such that label strap 14 preferably extends around front side 12*a* and rear side 12*b* of board 12 (rear side 12*b* shown below in FIG. 1B). This presents display surface 14*a* of label strap 14 for viewing, which may include printed indicia 15, such as textual indicia, illustrative indicia, machine-readable indicia, and the like. For instance, display surface 14*a* may include product-related information for board 12, such as a brand logo, UPC code, safety and use instructions, and the like. If desired, the back surface of label band 14 that rests against board 12 (referred to as back surface 14*b*, shown below in FIG. 3B) may also include printed indicia 15.

Label strap 14 may be produced from any suitable printable material, such as paper-based and/or polymeric materials, and may be a single-layer or multiple-layer strap. For printed indicia 15, any suitable ink or other printing composition compatible or accepted on label strap 14, in any desired color(s), may be used.

In some embodiments, label strap 14 is produced from one or more paper-based materials suitable for receiving printed indicia 15. Many paper-based materials are known for their compatibility with printing inks. However, the material for label strap 14 is also preferably water resistant so as to not degrade or otherwise deform when exposed to water, and is also preferably tough enough to be sufficiently tear resistant to deter damage to it from customer handling.

In addition, printed indicia 15, particularly any printed machine-readable information (e.g., a bar code), should be sufficiently water resistant to avoid degradation when repeatedly subjected to water and washing operations (e.g., as is common for produce displays in supermarkets). Accordingly, label strap 14 produced from one or more paper-based materials may also include one or more polymeric layers configured to protect and reinforce the paper-based materials, and to protect any printed indicia 15. For example, display surface 14*a* of label strap 14 may include a thin film of water-insoluble, transparent plastic disposed over the indicia 15 to enhance water and wear resistance.

Alternatively, label strap 14 may be produced from one or more polymeric materials that may receive printed indicia 15, and may be opaque, translucent, or transparent, as individual needs may require. Suitable polymers for label strap 14 include polystyrenic thermoplastics, polyolefinic thermoplastics (e.g., polyethylene and polypropylene), polyesters, copolymers thereof, blends thereof, and the like.

The polymeric material(s) may be formulated so that printing inks are readily accepted on display surface 14*a*, and/or treated with special surface treatments to effect acceptance of printing inks. The surface treatment may enhance wettability and adhesion characteristics of label strap 14 to printing inks. The polymeric material(s) of label strap 14 may also optionally include one or more compatible additives to achieve coloration, opacification, resistance to degradation on exposure to some environments, improved impact properties, improved adhesion properties, and the like.

Additionally, the material(s) for label strap 14 are preferably non-elastic, such that label strap 14 itself is substantially non-stretchable. This prevents the printed indicia on display surface 14*a* from being distorted by the stretching. It cannot be emphasized enough that, in situations where reliable machine-readable information (e.g., UPC codes) is critical, the label strap 14 should be sufficiently non-elastic to avoid the risk of unscannable distortion for the machine-readable information. This non-stretchable characteristic also assists in maintaining good adhesion between label strap 14 and elastic bands 16, as discussed below.

In the shown example, label strap 14 is provided as a sheet or film-like member that is substantially longer than it is wide. However, label strap 14 may alternatively have any suitable dimensions, which may vary depending on the particular needs. For example, label strap 14 may have dimensions that cover the entirety of front side 12*a* and/or rear side 12*b* of board 12. Furthermore, label strap 14 may have dimensions and shapes that vary along its length, such as a sinusoidal pattern, widths that vary along the length, individually-tailored designs (e.g., brand logos), and the like. Moreover, label strap 14 may include cut-out holes with individually-tailored designs, if desired, to further provide information and aesthetic characteristics. In additional alternative embodiments, label strap 14 may be provided as multiple connected pieces to provide its overall shape (e.g., a first portion being paper-based and a second portion being polymeric).

As shown in FIG. 1B, labeling sleeve assembly 10 also includes multiple elastic bands 16, which hold label strap 14 closed as a loop around article 10 under elastic tension. To minimize their visual impact, elastic bands 16 are preferably retained at the rear side 12*b* of board 12. While illustrated with multiple elastic bands 16, labeling sleeve assembly 10 may include one or more elastic bands 16 to hold label strap 14 closed as a loop around board 12 under elastic tension, where the number of elastic bands 16 may vary depending on the dimensions of label band 14 and the size of board 12 (or other article(s)). However, labeling sleeve assembly 10 preferably includes a sufficient number of elastic bands 16 to hold label strap 14 closed as a loop around a desired article (e.g., board 12) without labeling sleeve assembly 10 prematurely separating during normal use, such as during transportation, storage, display, purchase, and customer use.

As further shown in FIG. 1B, the end segments of label strap 14 (referred to as end segments 18) preferably overlap to reside between rear side 12*b* of board 12 and elastic bands 16. This assists in sliding labeling band assembly 10 over board 12 to secure labeling sleeve assembly 10 around board 12 under elastic tension. Additionally, as discussed below, elastic bands 16 preferably include elastomeric materials. Many of these materials can leach oils over extended periods of time. Thus, positioning end segments 18 of label strap 14 between elastic bands 16 and the secured article prevents the leached oil from contacting the secured article. This can be beneficial for use with many absorbable articles, such as wooden or paper products (e.g., wooden cutting boards), which can otherwise absorbs such oils and potentially stain the articles.

Figure 2B:
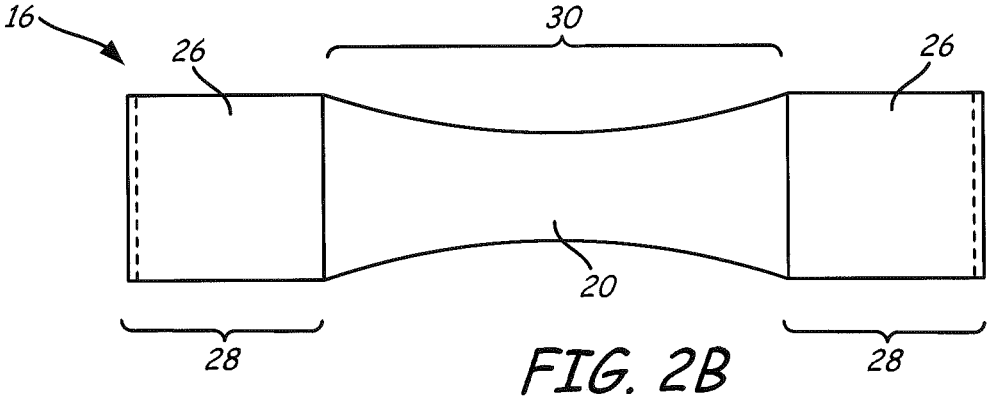
FIG. 2B is a rear view of the elastic band of FIG. 2A.
Figure 2C:
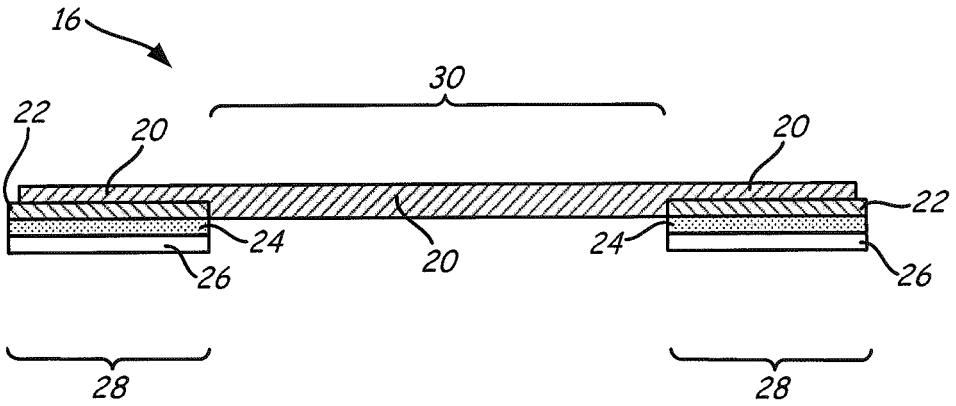
FIG. 2C is a side view of the elastic band of FIG. 2A, with separate layers distinguished by hatching for ease of visibility.

FIGS. 2A-2C illustrate an example elastic band 16, which may be used with any suitable label strap 14, and provides a unique mechanism for holding an associated label strap 14 closed as a loop under elastic tension. In some embodiments, elastic band 16 may be provided as a separate component from label strap 14, allowing elastic band 16 to be affixed to a variety of different label straps 14. Alternatively, as discussed below for FIGS. 15A-15C, 16A, and 16B, one or more elastic bands 16 may be partially connected to a label strap 14 during the manufacturing process, and prior to forming the label strap 14 into a loop.

In the embodiment shown in FIGS. 2A-2C, elastic band 16 is a multiple-layer band having elastic layer 20, a pair of support layers 22, a pair of adhesive layers 24, and a pair of liners 26. Support layers 22, adhesive layers 24, and liners 26 define opposing and separate anchor regions 28 connected by a bridging segment 30 of elastic layer 20.

Elastic layer 20 may be derived from one or more elastomeric materials capable of providing elastic characteristics to bridging segment 30. Suitable elastomeric materials for elastic layer 20 include thermoplastic elastomers, such as styrenic block copolymers (e.g., styrene-butadiene styrene and styrene-ethylene-butylene styrene), olefinic elastomers (e.g., ethylene and polypropylene based polyvinyl chloride-based elastomers, urethanes, nylon, silicon, and the like).

The elastomeric material(s) provide elastic layer 20 with sufficient elasticity such that bridging segment 30 may be stretched from a relaxed state to a stretched state (where anchor regions 28 are spaced further apart from each other), and may contract back from its stretched state to its relaxed state. Suitable average thicknesses for elastic layer 20 in its relaxed state range from about 10 mils to about 50 mils, where bridging segment 30 may be thicker than the segments of elastic layer 20 at anchor regions 28, as shown in FIG. 2C. In alternative embodiments, typically depending on how elastic band 16 is manufactured, elastic layer 20 may have a substantially uniform thickness above support layers 22, or bridging segment 30 may extend down to be flush with adhesive layers 24.

Support layers 22 provide structural integrity to anchor regions 28, and transfer stretching-based stress loads applied to anchor regions 28 during use. This preserves the adhesive bonds between anchor regions 28 and label strap 14, as discussed below. Support layers 22 are preferably produced from one or more non-elastic materials, such as paper-based materials, polymeric materials, metallic materials, and the like, such that support layers 22 are substantially non-stretchable. Examples of suitable materials for support layers 22 include those discussed above for label tag 14, which preferably maintain good interlayer bonds to elastic layer 20 and adhesive layers 24. In some embodiments, support layers 22 may also be surface treated to increase the interlayer bonds to elastic layer 20 and adhesive layers 24. Suitable average thicknesses for support layers 22 range from about 5 mils to about 20 mils.

Adhesive layers 24 may be produced from one or more adhesive materials that are suitable for securely adhering anchor regions 28 to end segments 18 of label strap 14. Examples of suitable adhesive materials for adhesive layers 14 include pressure sensitive adhesives (PSAs) (e.g. hot-melt PSAs), such as those based on acrylic monomers and polymers (e.g., bio-based acrylates), block copolymer rubber adhesives, silicone rubber adhesives, and the like, which may optionally include one or more additional tackifying resins. Suitable average thicknesses for adhesive layers 24 range from about 5 mils to about 30 mils. As discussed below, in some embodiments, support layers 22 and adhesive layers 24 may be provided together, such as with a label stock.

Liners 26 are release liners or other suitable carrier webs that are configured to releasably cover adhesive layers 24 prior to use with label strap 14. Liners 26 may be fabricated from a paper and/or polymeric web (e.g., a polyolefin and/or polyethylene terephthalate web) coated with one or more release agents (e.g., a silicone release coating). This allows elastic bands 16 to be packaged, transported, and stored prior to being affixed to label strap 14.

The dimensions of anchor regions 28 and bridging segment 30 may vary depending on the particular uses. However, bridging segment 30 is preferably short enough to maintain good elastic tension on label strap 14, thereby preventing label strap 14 from sliding off of board 12 or other article(s). Nonetheless, bridging segment 30 is also preferably long enough to prevent excessive stretching from being required to slide labeling sleeve assembly 10 over board 12. Correspondingly, anchor regions 28 are preferably large enough such that adhesive layers 24 exhibit good adhesive bonding to end segments 18 of label strap 14 while under the elastic tension from bridging segment 30.

Furthermore, in the embodiment shown in FIGS. 2A-2C, elastic layer 20 does not extend across the entirety of support layers 22, exposing portions of support layers 22 at anchor regions 28 (best illustrated in FIGS. 2A and 2C). This arrangement may be beneficial for relaxing manufacturing tolerances, allowing a small amount of registration float to exist when forming elastic layer 20 on support layers 22. However, in alternative embodiments, elastic layer 20 may cover the entirety of support layers 22, or even past support layers 22, if desired (see e.g., FIGS. 10G and 10H below).

Figure 3A:
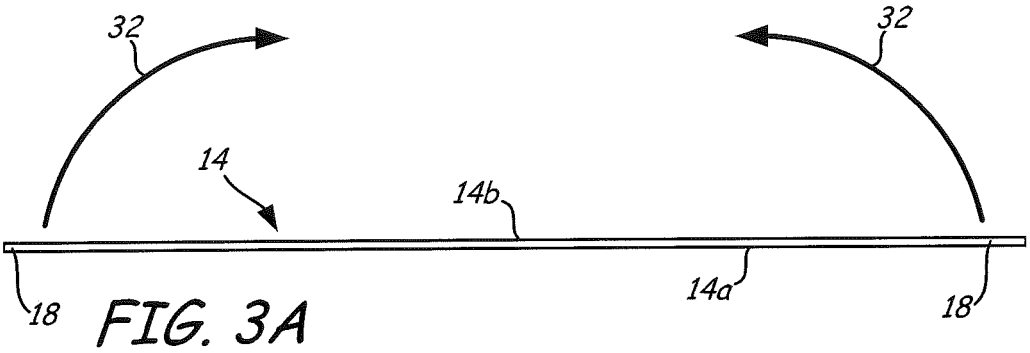
FIGS. 3A-3G are schematic illustrations of a first technique for forming and securing the labeling sleeve assembly around an article.

Labeling sleeve assembly 10 may be formed from label strap 14 and one or more elastic bands 16, and secured around one or more articles, using any suitable technique. FIGS. 3A-3G and 4A-4F shown below illustrate two different example techniques. In the first example technique shown in FIGS. 3A-3G, a labeling sleeve assembly 10 is initially formed as a loop, and is then slid over an article (e.g., board 12). As shown in FIG. 3A, this technique may initially involve forming label strap 14 into a suitable loop for board 12. For instance, as illustrated by arrows 32, end segments 18 may be folded over together to form a loop 34, which, in the current example, has a substantially rectangular geometry, as shown in FIG. 3B.

The term "loop" refers to an enclosed or substantially enclosed orientation of a label strap, which allows the label strap to be secured around one or more articles. Correspondingly, the terms "fold", "folding", "folded" and the like, with reference to forming a loop from the label strap, include any suitable manipulation of the label strap to form the loop, and do necessarily not require crease lines to be formed in label strap 14. As further explained below in FIGS. 6A-8C, the formed loop may have any suitable geometric shape for being secured around a given article(s) (e.g., circular, rectangular, irregular, and the like), which typically conforms to a "footprint perimeter" of the article(s) under the elastic tension.

Figure 3B:
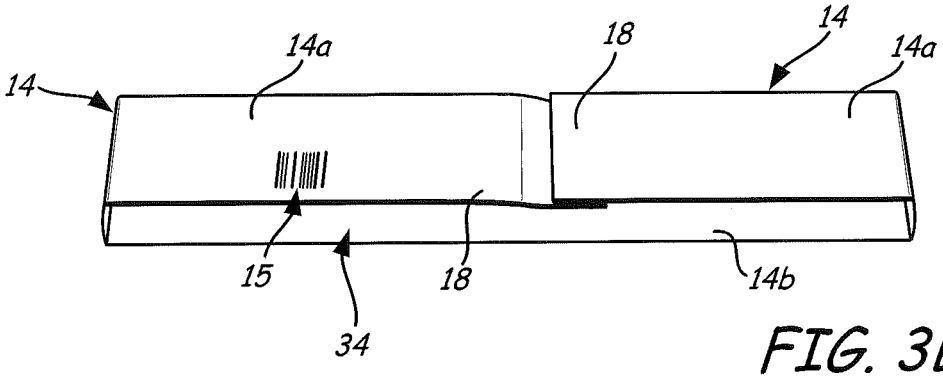

As shown in FIG. 3B, the formation of loop 34 positions display surface 14*a* on the exterior side of loop 34, and positions backing surface 14*b* of label strap 14 on the interior side of loop 34. As mentioned above, end segments 18 preferably overlap, as shown, such that display surface 14*a* at one of end segments 18 extends behind backing surface 14*b* of the other end segment 18. However, in alternative embodiments, end segments 18 may abut against each other, or be separated by a small offset distance that is less than the distance between the anchor regions 28 of the associated elastic bands 16 (i.e., a substantially enclosed orientation for loop 34).

Figure 3C:
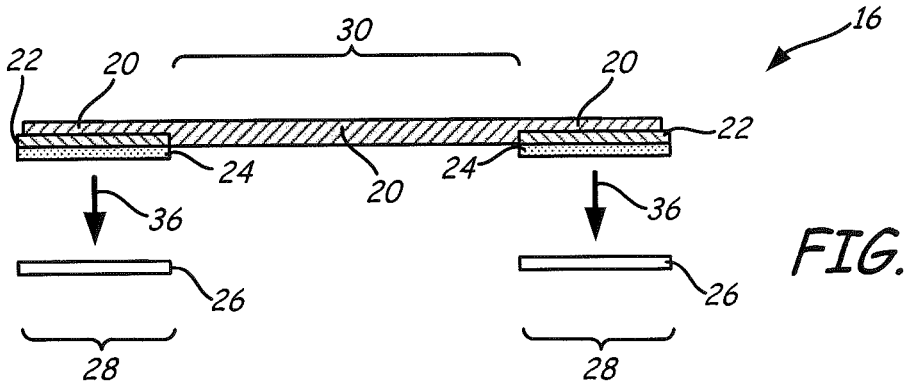

As shown in FIG. 3C, for each elastic band 16, the technique may involve removing liners 26 from adhesive layers 24, as illustrated by arrows 36, to expose adhesive layers 24. Liners 26 may be removed from adhesive layers 24 at any suitable time, such as prior to, after, or simultaneously with forming label strap 14 into loop 34.

Figure 3D:
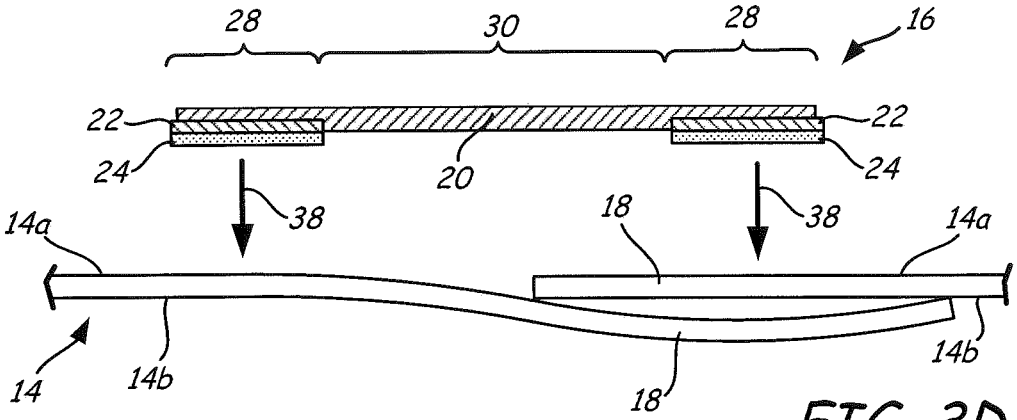

As shown in FIG. 3D, while end segments 18 are held in the overlapped manner, each elastic band 16 may be affixed to label strap 14, as illustrated by arrows 38. In particular, this involves adhering one of the exposed adhesive layers 24 to display surface 14*a* at one of end segments 18, and adhering the other exposed adhesive layer 24 to display surface 14*a* at the other end segment 18. This secures anchor regions 28 to the opposing end segments 18, thereby securing label strap 14 as loop 34, which forms labeling sleeve assembly 10 (as shown in FIG. 3E).

If desired, each elastic band 16 may be stretched by a small amount after adhering the first anchor region 28 to label strap 14, and prior to adhering the second anchor region 28 to label strap 14. Thus, when both anchor regions 28 are adhered and the small amount of stretching is then released, the resulting contraction of bridging segment 30 to its relaxed state pulls end segments 18 of label strap 14 together to reduce the size of loop 34 by a small amount.

Figure 3E:
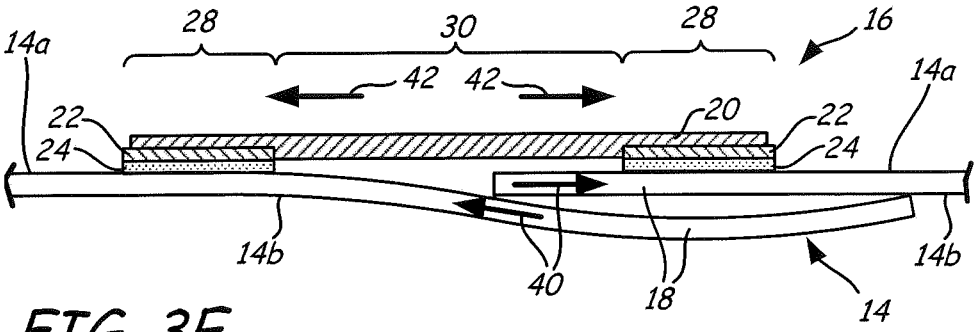
Figure 3F:
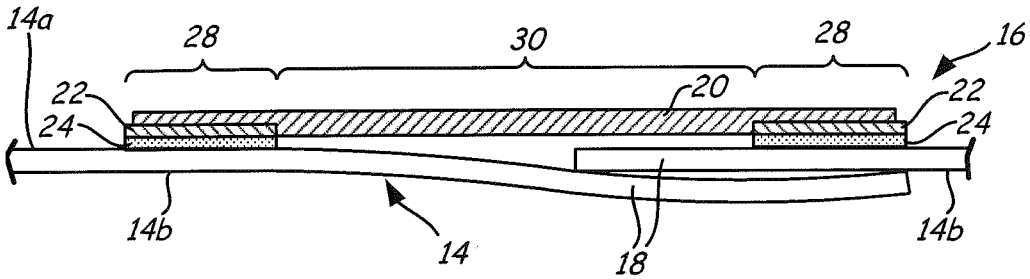
Figure 3G:
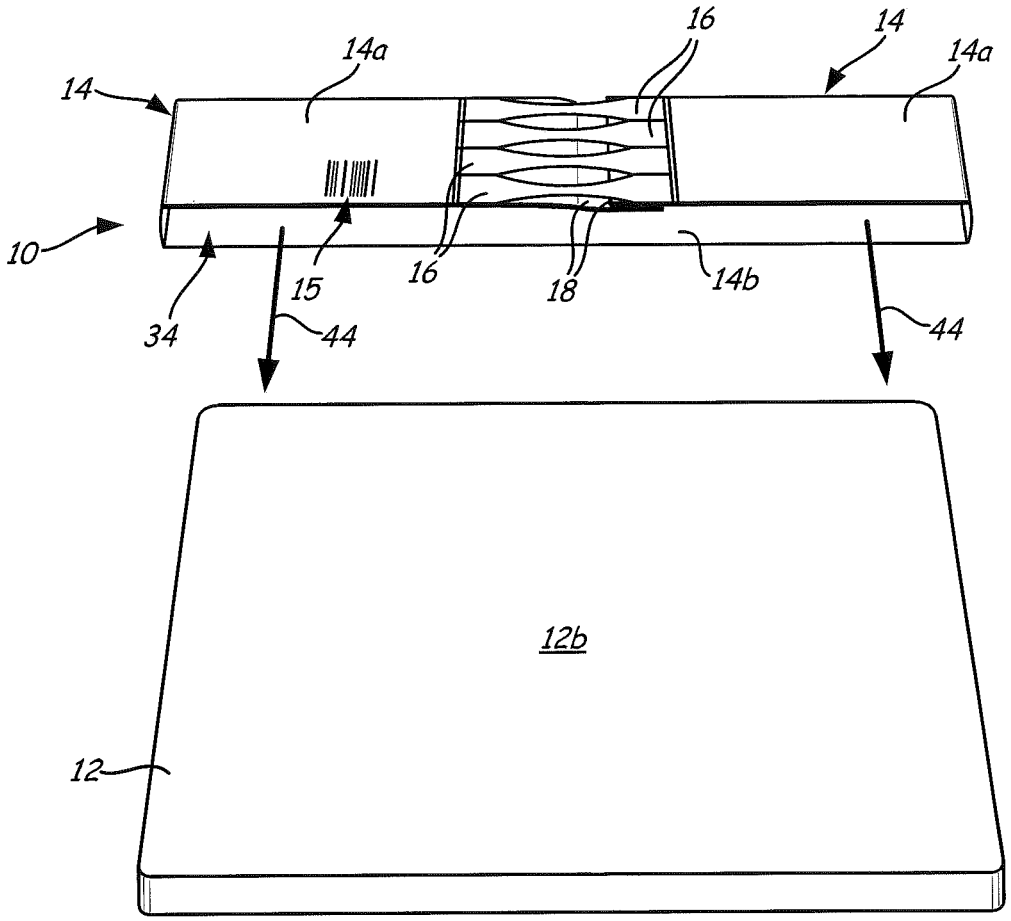

FIGS. 3E-3G illustrate an example technique for securing the formed labeling sleeve assembly 10 to board 12, and may alternatively be used with any suitable article (or multiple bundled articles). As shown in FIG. 3E, this technique may involve stretching labeling sleeve assembly 10 to an expanded state that is preferably large enough to fit around the perimeter of board 12.

As mentioned above, label strap 14 is preferably produced from material(s) that are non-elastic to prevent the printed indicia 15 on display surface 14*a* from being distorted by the stretching. As such, the stretching of labeling sleeve assembly 10 preferably does not stretch label strap 14. Instead, end segments 18 of label strap 14 pull apart at the overlapping region, as illustrated by arrows 40. This accordingly applies stretching-based stress loads on elastic bands 16.

As can be appreciated, these applied stress loads originate at the adhesive bonds between adhesive layers 24 and end segments 18 of label strap 14. As such, these adhesive bonds are required to be stronger than the applied stress loads to hold label strap 14 closed as loop 34 in the stretched state. Otherwise, one or both of these adhesive bonds will break. Therefore, any phenomenon that weakens these adhesive bonds is preferably reduced or prevented.

An interesting aspect of elastic band 16 is the fact that support layers 22 stiffen their respective adhesive layers 24 in the layer-wise plane that is parallel to the stretching directions. This stiffening prevents adhesive layers 24 themselves from stretching under the transferred stress loads. In effect, this causes adhesive layers 24 to be substantially non-elastic (i.e., substantially non-stretchable), without requiring the use of non-elastic materials in adhesive layers 24 that could otherwise dilute the adhesive properties.

If support layers 22 were otherwise omitted, the transferred stress loads could cause adhesive layers 24 themselves to stretch. This stretching of adhesive layers 24 could correspondingly weaken the adhesive bonds between adhesive layers 24 and end segments 18 of label strap 14, which would undesirably reduce the adhesive bond strengths.

Instead, the stiffness attained by support layers 22 transfers the received stress loads to bridging segment 30 of elastic band 16. In comparison to support layers 22, bridging segment 30 is a section of elastic layer 20, which is produced from one or more elastomeric materials. As such, the stress loads transferred from anchor regions 28 to bridging segment 30 cause bridging segment 30 to stretch from its relaxed state to a stretched state, as illustrated by arrows 42. As shown in FIG. 3F, this allows labeling sleeve assembly 10 to be stretched to an expanded loop size to fit around the footprint perimeter of board 12, while also maintaining good adhesive bonds between label strap 14 and elastic bands 16.

As shown in FIG. 3G, the stretched labeling sleeve assembly 10 may then be slid over board 12, as illustrated by arrows 44, until an intended placement location is reached. The "intended placement location" is a location along an article (or bundle of articles) where labeling sleeve assembly 10 is intended to be placed for display. Because end segments 18 of label strap 14 preferably reside between elastic band 16 and rear side 12*b* of board 12 in the overlapped arrangement, the elastomeric material of elastic layer 20, which typically has a rubbery texture that inhibits sliding, does not contact rear side 12*b*. As such, the stretched labeling sleeve assembly 10 may readily slide over board 12 without undue resistance. This is achieved because backing surface 14*b* of label strap 14 is preferably smoother and less grippy than the elastomeric material(s) of elastomer layer 20 (i.e., a lower kinetic friction to the article(s)).

Once the intended placement location is reached, the stretching load applied to labeling sleeve assembly 10 may be released, allowing bridging segment 30 to contract partially back to its relaxed state to hold labeling sleeve assembly 10 around board 12 under elastic tension, as shown above in FIG. 1B. While labeling sleeve assembly 10 is secured around board 12 in this manner, end segments 18 preferably remain overlapped to prevent direct contact between the elastomeric material of elastic layer 20 and board 12. As mentioned above, this reduces the risk of any oil leaching from the elastomeric material(s) of elastic layer 20 into board 12. It also allows labeling sleeve assembly 10 to be easily removed from board 12 without undue resistance, which may be performed in the opposite order of the steps shown in FIGS. 3E-3G.

Figure 4A:
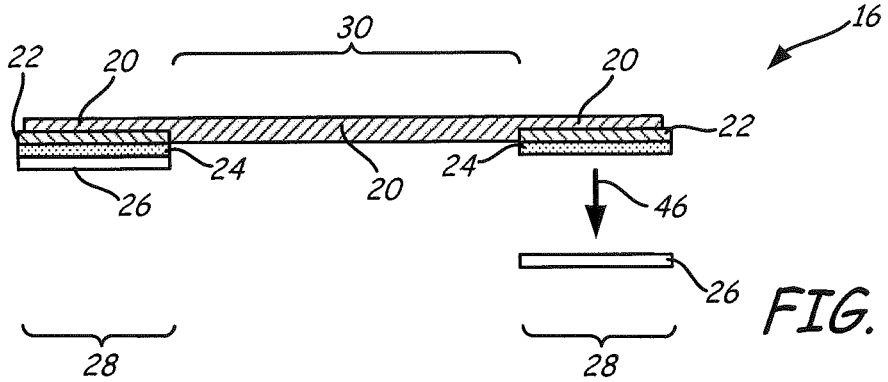

FIGS. 4A-4F illustrate a second example technique, where label strap 14 is initially wrapped around one or more articles (e.g., board 12), and then secured with one or more elastic bands 16 to hold the label strap 14 closed as loop 34 around the article(s) under elastic tension. As shown in FIG. 4A, this technique may initially involve removing liner 26 from one of the adhesive layers 24, as illustrated by arrow 46, to expose the adhesive layer 24. If desired, both liners 26 may optionally be removed at this point.

Figure 4B:
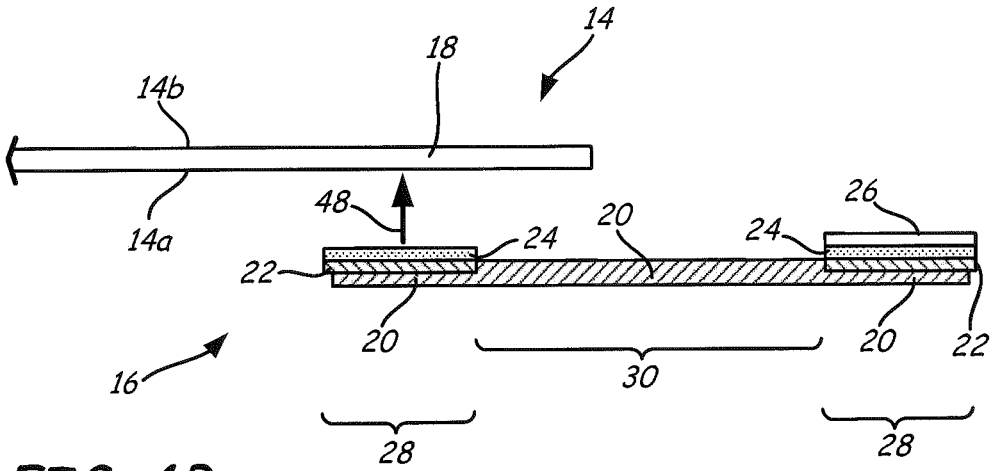

As shown in FIG. 4B, the anchor region 28 of elastic band 16 with the exposed adhesive layer 26 may be affixed to display surface 14*a* of label strap 14, as illustrated by arrow 48. In particular, this involves adhering the exposed adhesive layer 24 to display surface 14*a* at one of end segments 18, but not yet adhering the other exposed adhesive layer 24 to display surface 14*a* at the other end segment 18.

Figure 4C:
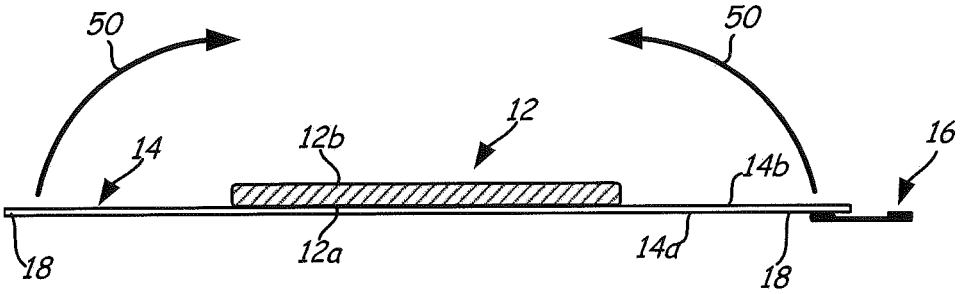
Figure 4D:
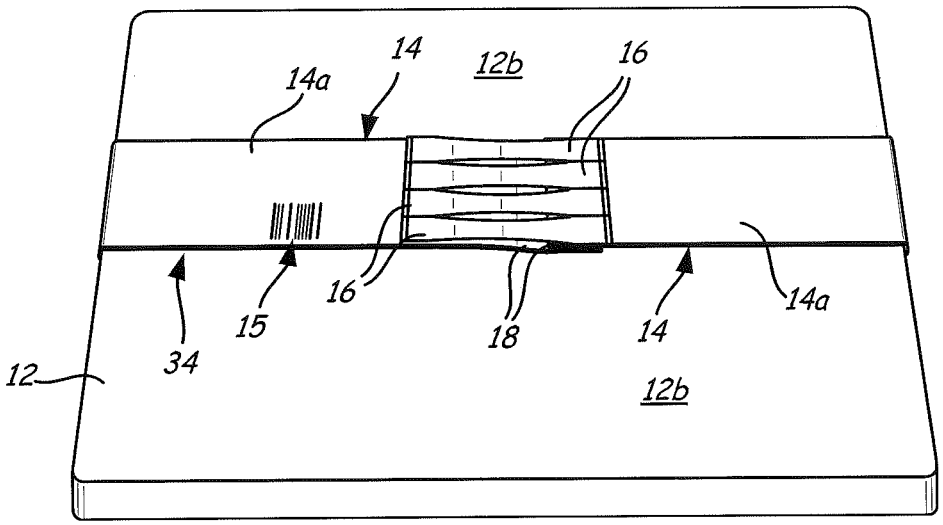

As shown in FIG. 4C, label strap 14 may then be wrapped around board 12 (or other article(s)) at the intended placement location to form loop 34, as illustrated by arrows 50. As shown in FIG. 4D, this positions backing surface 14*b* of label strap 14 against board 12, such that display surface 14*a* is on the exterior side of loop 34. This wrapping preferably conforms loop 34 to the footprint perimeter of board 12 (footprint perimeter is defined below), but does not yet need to place label strap 14 under tension. In other words, label strap 14 may be somewhat loosely wrapped around board 12 so long as label strap 14 does not slide along board 12 from the intended placement location.

Figure 4E:
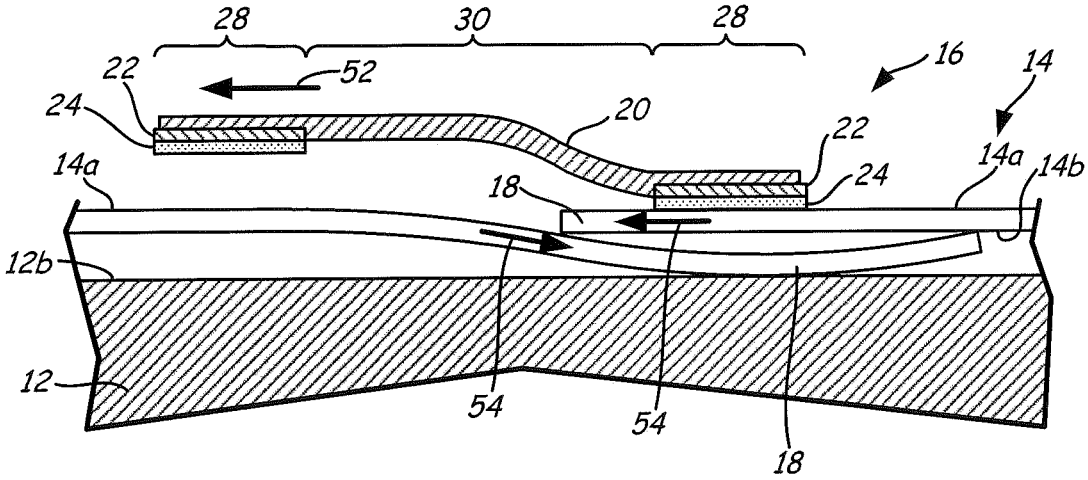

At this point in the process, for each elastic band 16, the non-adhered anchor region 28 preferably remains non-adhered to label strap 14 (e.g., with the liner 26 still attached to the adhesive layer 24). Instead, as shown in FIG. 4E, the non-adhered anchor region 28 may be pulled in the direction of arrow 52 to stretch bridging segment 30. In the same manner as discussed above, the stiffness attained by support layers 22 transfers the stretching-based stress loads from bridging segments 30 of elastic bands 16 to label strap 14. As such, when bridging segment 30 expands from its relaxed state to its stretched state, the stress loads transferred from anchor regions 28 to label strap 14 pull one or both of end segments 18 together under the elastic tension, as illustrated by arrows 54.

Then, as shown in FIG. 4F, the pulled anchor region 28 may be affixed to label strap 14 while bridging segment 30 remains stretched. This involves removing liner 26 (if not previously done so), and adhering the exposed adhesive layer 24 to display surface 14*a* at the non-bonded end segment 18, as illustrated by arrow 56. This provides labeling sleeve assembly 10 secured around board 12 under elastic tension, as also shown above in FIG. 1B. Accordingly, the techniques discussed above in FIGS. 3A-3G and 4A-4F illustrate two suitable techniques for attaining the same labeling sleeve assembly 10 secured around board 12 under elastic tension.

A surprising feature of labeling sleeve assembly 10 is the ability to hold label strap 14 closed as loop 34 around an article(s) under elastic tension, without stretching label strap 14 itself. In order to produce this elastic tension of labeling sleeve assembly 10 around board 12 (or other article(s)), loop 34, when not stretched, is preferably smaller than board 12 (or other article(s)) at the intended placement location. Stated another way, the interior perimeter length of loop 34 is preferably shorter than the length of the footprint perimeter of board 12 (or other article(s)) at the intended placement location when elastic band 16 is in its relaxed state (i.e., when bridging segment 30 is in its relaxed state).

First, the "interior perimeter length" of loop 34 refers to the length of label strap 34 when folded as loop 34. In situations where end segments 18 abut each other in loop 34, but do not overlap, the interior perimeter length of loop 34 is the same (or substantially the same) as the length of label strap 14. Alternatively, in preferred situations where end segments 18 overlap each other in loop 34, the interior perimeter length of loop 34 is the length of label strap 14 minus the overlap length of one of end segments 18. In another, and less preferred situation, end segments 18 may be offset from each other by a small distance in loop 34 (i.e., spaced apart from each other). In this case, interior perimeter length of loop 34 is the length of label strap 14 plus the small offset distance.

Next, the "footprint perimeter" of an article or multiple articles refers to a boundary that encompasses an entire cross-sectional geometry of a footprint of the article(s) at the intended placement location. Correspondingly, the "length" of the footprint perimeter is the length of this boundary. The following discussion in FIGS. 5A-8C provide examples on how this definition is applied to articles of various geometries.

In a simple example, such as with board 12 as shown in FIG. 5A, board 12 has a substantially rectangular cross-sectional geometry at the intended placement location. This cross-sectional geometry is defined by front side 12*a*, rear side 12*b*, and edge sides of board 12 (referred to as sides 12*c* and 12*d*). As such, as shown in FIG. 5B, the footprint of board 12 at the intended placement location (referred to as footprint 62) has the same substantially rectangular cross-sectional geometry. Accordingly, the boundary or perimeter of footprint 62 is defined by surfaces 62*a*-62*d*, and the length of this boundary (i.e., the length of the footprint perimeter of board 12) is the sum of the lengths of surfaces 62*a*-62*d* (which correspond to the sum of the lengths of sides 12*a*-12*d*).

In another simple example, as shown in FIG. 6A, a cylindrical article 64 has a circular cross-sectional geometry at the intended placement location, which is defined by circular surface 64*a*. As such, as shown in FIG. 6B, the footprint of cylindrical article 64 at the intended placement location (referred to as footprint 66) has the same circular cross-sectional geometry. The boundary or perimeter of footprint 66, therefore, is defined by surface 66*a*, and the length of this boundary (i.e., the length of the footprint perimeter of cylindrical article 64) is the length of surface 66*a* (which corresponds to the length of circular surface 64*a*).

Figure 7A:
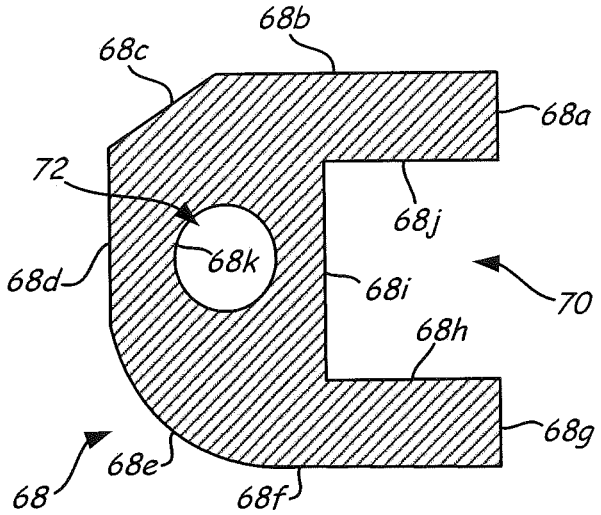
FIGS. 7A-7C illustrate a technique for determining a footprint perimeter of an irregular article.

However, as shown in FIG. 7A, irregular article 68 has an irregular geometry cross-sectional geometry at the intended placement location, which is defined by surfaces 68*a*-68*k*. In comparison to board 12 (shown in FIG. 5A) and cylindrical article 64 (shown in FIG. 6A), irregular article 68 has recessed and interior regions, namely recessed pocket 70 defined by surfaces 68*g*-68*j*, and interior region 72 defined by surface 68*k*.

As can be appreciated, when labeling sleeve assembly 10 is secured around irregular article 68 under elastic tension at the intended placement location, label strap 14 and/or elastic band 16 will extend across recessed pocket 70 rather than extending into it. Similarly, labeling sleeve assembly 10 will not extend into any interior region, such as interior cavity 72.

Figure 7B:
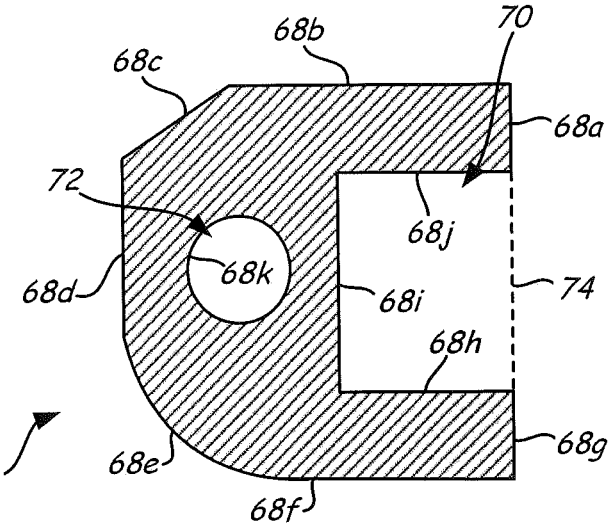

Accordingly, as shown in FIG. 7B, the footprint of irregular article 68 at the intended placement location may be determined by placing an imaginary segment across any recessed region in the exterior surface, such as segment 74 across recessed pocket 70, and ignoring the interior regions, such as interior region 72.

Figure 7C:
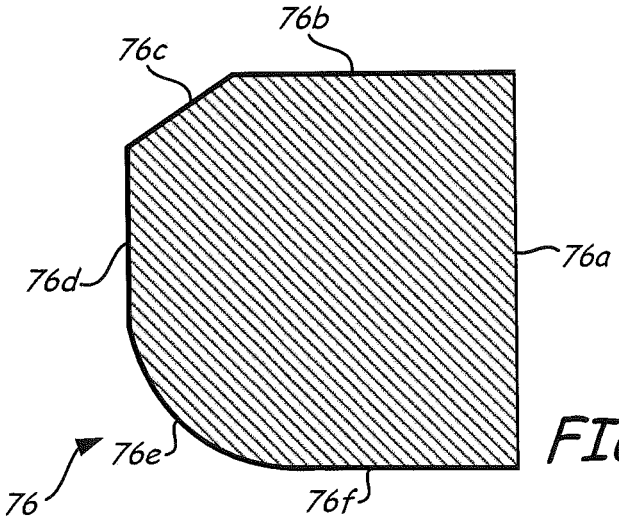

As shown in FIG. 7C, the resulting footprint (referred to as footprint 76) has a cross-sectional geometry that substantially encompasses the recessed and interior regions. Correspondingly, the boundary or perimeter of footprint 76 is therefore defined by surfaces 76*a*-76*e*, and the length of this boundary (i.e., the length of the footprint perimeter of irregular article 68) is the sum of the lengths of surfaces 76*a*-76*f*. In this case, the length of surface 76*a* is the sum of the lengths of surface 68*a*, surface 68*g*, and segment 74 (shown in FIG. 7B).

Figure 8A:
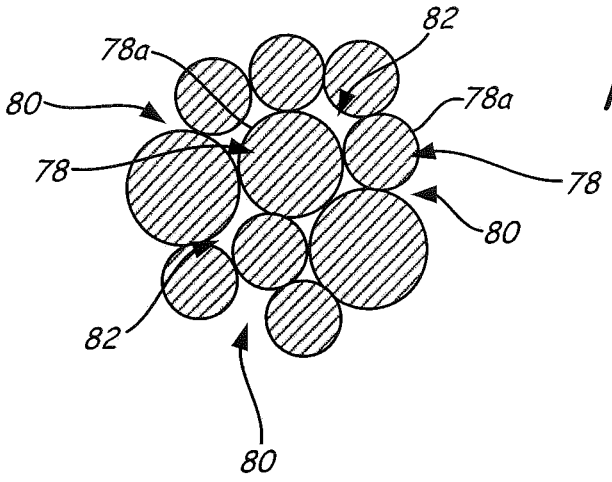
FIGS. 8A-8D illustrate a technique for determining a footprint perimeter of multiple bundled articles.

FIG. 8A illustrates yet another complex situation, in which multiple articles 78 are to be bundled together. In this case, articles 78 have separate geometry cross-sectional geometries at the intended placement location, which are defined by the individual surfaces 78*a* of articles 78. However, the bundle of articles 78 also includes recessed and interstitial regions between the separate articles 78, namely recessed pockets 80 (at the exterior regions) and interstitial regions 82 (at the interior regions).

As can also be appreciated in this situation, when labeling sleeve assembly 10 is secured around articles 78 under elastic tension at the intended placement location, label strap 14 and/or elastic band 16 will extend across recessed pockets 80 rather than extending into them. Similarly, labeling sleeve assembly 10 will not extend into any interstitial regions between the adjacent articles 78, such as interstitial regions 82.

Figure 8B:
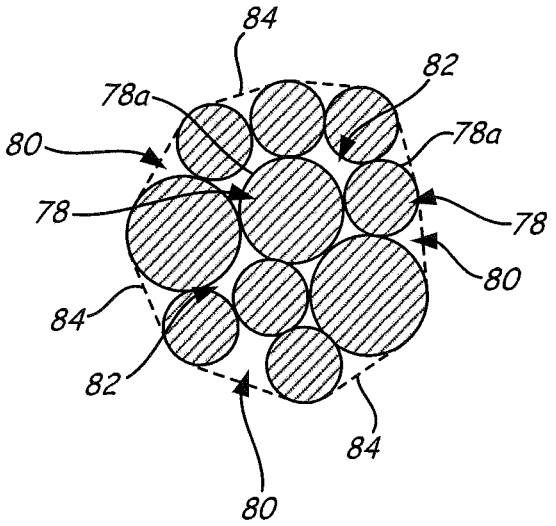

Accordingly, as shown in FIG. 8B, the footprint of articles 78 at the intended placement location may be determined by placing an imaginary segment across any recessed pocket between the exterior-most portions of surfaces 78*a*, such as segments 84 across recessed pockets 80, and ignoring the interstitial regions, such as interstitial regions 82.

Figure 8C:
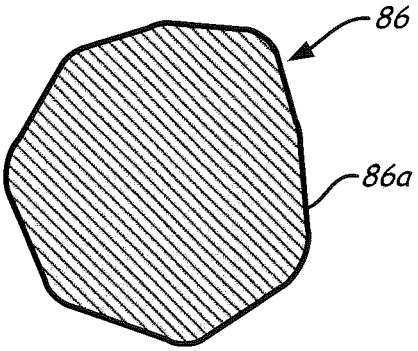
Figure 8D:
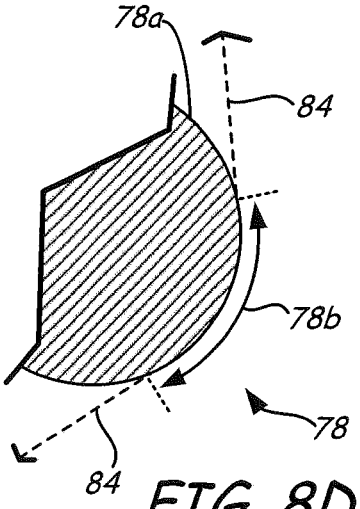

As shown in FIG. 8C, the resulting footprint (referred to as footprint 86) has a cross-sectional geometry that substantially encompasses the recessed and interstitial regions. Correspondingly, the boundary or perimeter of footprint 74 is therefore defined by surface 86*a*, and the length of this boundary (i.e., the length of the footprint perimeter of the bundle of articles 78) is the length of surface 86*a*. In this case, the length of surface 86*a* is the sum of the lengths of exterior-most portions of surfaces 78*a* extending between segments 84, plus sum of the lengths of segments 84. As shown in FIG. 8D, the length of an exterior-most portion of surface 78*a* for each article 78 is taken along the surface 78*a* between the intersecting segments 84, as represented by arrow 78*b*.

The above discussions of board 12, cylindrical article 64, irregular article 68, and bundled articles 78 were made under the assumptions that these articles are rigid and non-compressible. However, in some situations, the articles that labeling sleeve assembly 10 is secured around may be compressible, such as pillows, stacks of clothing, bed linen, and the like.

These types of articles may deform at the intended placement location under the elastic tension of labeling sleeve assembly 10. This causes the footprint perimeters of these articles to be reduced by an extent that is dependent on the applied elastic tension and the compressibility of the articles. As such, in these cases, the interior perimeter length of loop 34 is preferably sized to maintain a sufficient amount of elastic strain on the compressed article(s) to prevent labeling sleeve assembly 10 from sliding off the given article(s).

Accordingly, the elastic tension for securing labeling sleeve assembly 10 around one or more articles (e.g., board 12, cylindrical article 64, irregular article 68, and bundled articles 78) is achieved because the interior perimeter length of loop 34 in the relaxed state is shorter than the length of the footprint perimeter of the article(s) at the intended placement location (i.e., loop 34 is smaller than the respective article(s)). In comparison, when labeling sleeve assembly 10 is expanded to its stretched state for placement around the article(s) (e.g., as shown in FIGS. 3A-3G), the interior perimeter length of loop 34 in the stretched state is longer than the length of the footprint perimeter of the article(s), allowing labeling sleeve assembly 10 to be placed around the article(s).

However, when the stretching load is released, the elastomeric material of bridging segment 30 attempts to contract back to its relaxed state to the fullest extent possible, which contracts loop 34 around the article(s) at the intended placement location. This contraction reduces the length of loop 34 substantially to the length of the footprint perimeter of the article(s) at the intended placement location, thereby snugly holding labeling sleeve assembly 10 around the article(s). This unique mechanism is surprisingly durable and efficient for reliably displaying information (e.g., indicia 15) in a prominent manner, which may also be conveniently secured to, and removed from, the article(s) with little effort.

Label strap 14 and elastic band 16 may each be manufactured using a variety of different techniques. For example, a supplier may manufacture and sell the label straps 14 and the elastic bands 16, not affixed to each other, but packaged together in a kit. In this case, the given supplier may receive instructions from a customer for printing label straps 14 with a particular design for indicia 15. The supplier may then produce label straps 14, and print indicia 15 on display surface 14*a* and/or backing surface 14*b*. The supplier may also manufacture elastic bands 16 for use with the printed label straps 14, and then package and ship the items to the customer for use. The customer may then form the label sleeve assemblies 10 from the received label straps 14 and elastic bands 16, and secure them around various articles, manually or in an automated manner, as discussed above.

Figure 9A:
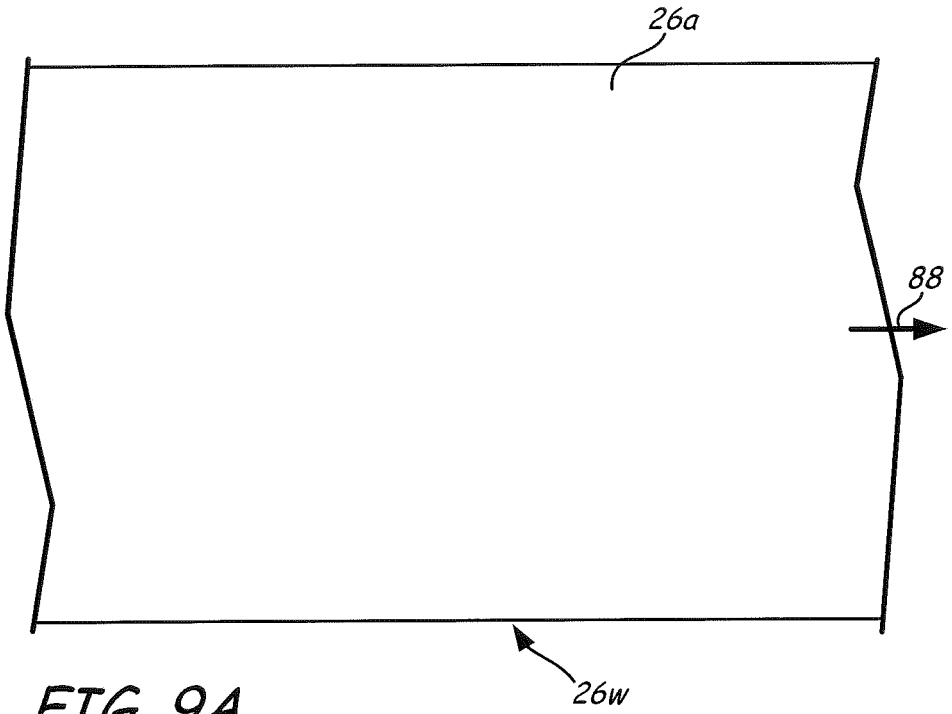
FIGS. 9A-9F are schematic illustrations of an example web-based process for manufacturing multiple elastic bands of the present disclosure.

Label strap 14 may be produced in a conventional film or sheet production process, followed by a printing process to form printed indicia 15 on display surface 14*a* and/or backing surface 14*b*. Elastic bands 16 may also be produced using a web-based production process. For example, FIGS. 9A-9E illustrate a suitable method for manufacturing multiple elastic bands 16 using a web-based process. As shown in FIG. 9A, the process may initially involve advancing a web of a material for liner 26 (referred to as liner web 26*w*) in the direction of arrow 88.

The shown surface of liner web 26*w*, referred to as liner surface 26*a*, is preferably the surface that is coated with the one or more release agents for releasably adhering to adhesive layers 24. In an alternative embodiment, separate web-based strips of liner web 26*w* (not shown) may be formed rather than a single web, where the separate strips are preferably maintained offset from each other with proper registration.

Figure 9B:
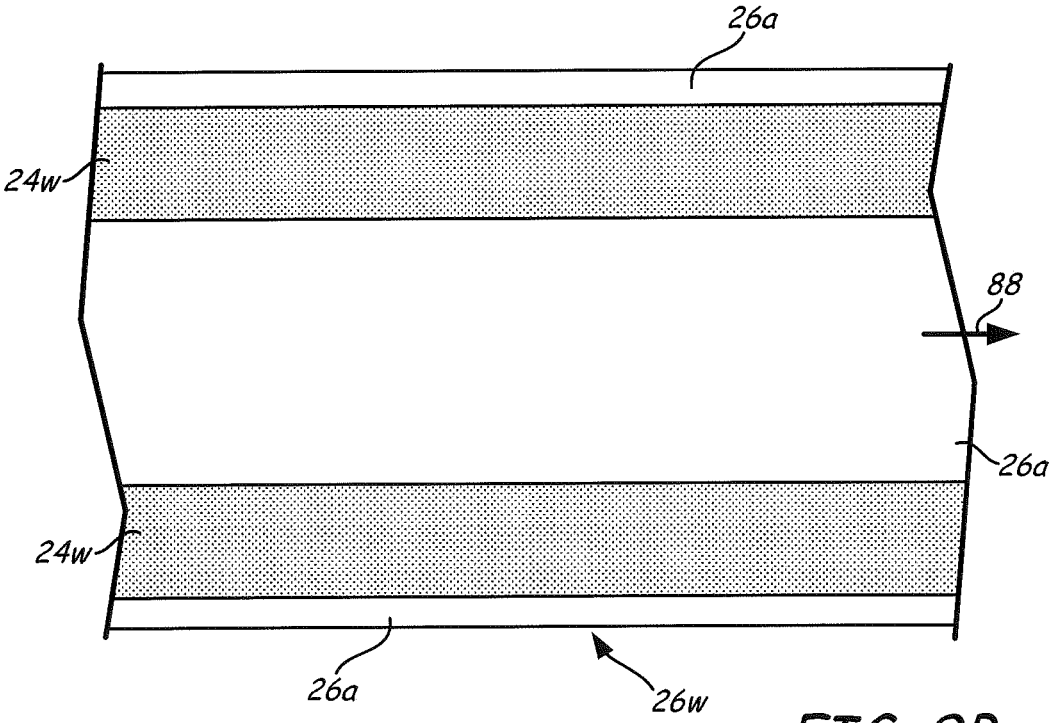

As shown in FIG. 9B, web-based strips of the adhesive material(s) for adhesive layers 24 (referred to as adhesive strips 24*w*) may then be laminated over regions of liner surface 26*a*. For instance, the adhesive material(s) may be extruded onto liner surface 26*a* and sized with a die roller mechanism.

Figure 9C:
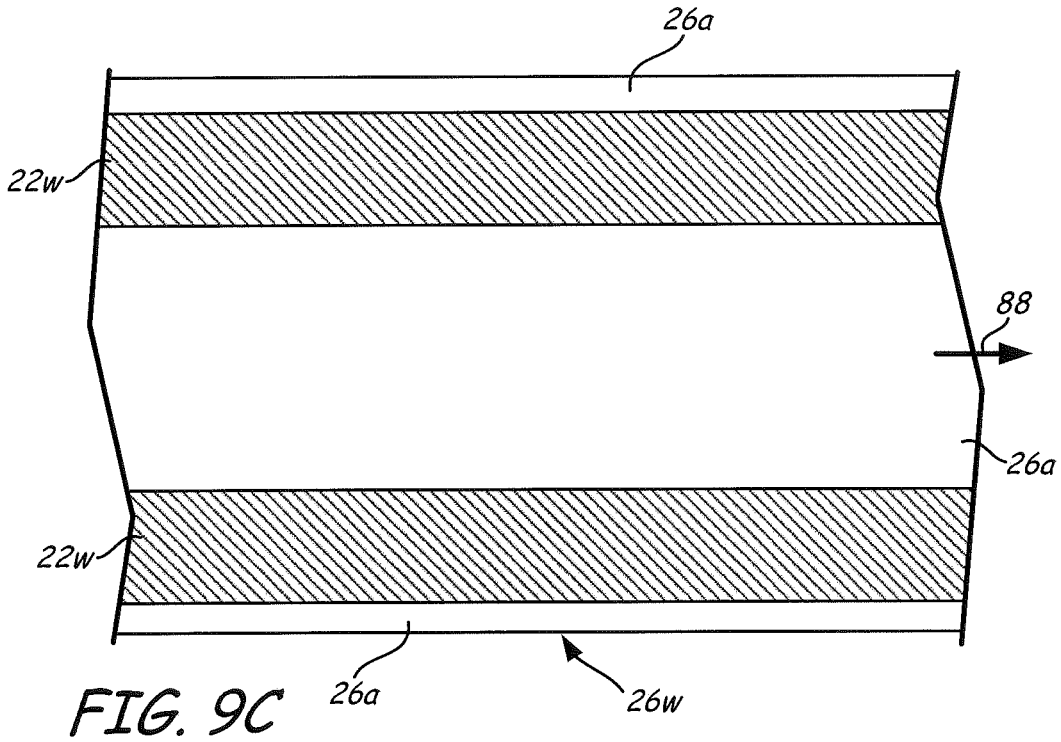

As shown in FIG. 9C, web-based strips of the non-stretchable material(s) for support layers 22 (referred to as support strips 22*w*) may then be laminated over adhesive strips 24*w*. The technique for laminating the material(s) of support strips 22*w* may vary depending on the particular material(s) used. For example, in embodiments in which the material(s) of support strips 22*w* are polymeric material(s), the material(s) may be extruded onto adhesive strips 24*w* with proper registration, and sized with a die roller mechanism. Alternatively, in embodiments in which the material(s) of support strips 22*w* are paper-based material(s), strips of the paper-based material(s) may be laminated onto adhesive strips 24*w* with proper registration, and press fit with a die roller mechanism. In some embodiments, the web shown in FIG. 9C with liner web 26*w*, adhesive strips 24*w*, and support strips 22*w* may be provided as a label stock that may undergo the subsequent steps.

Figure 9D:
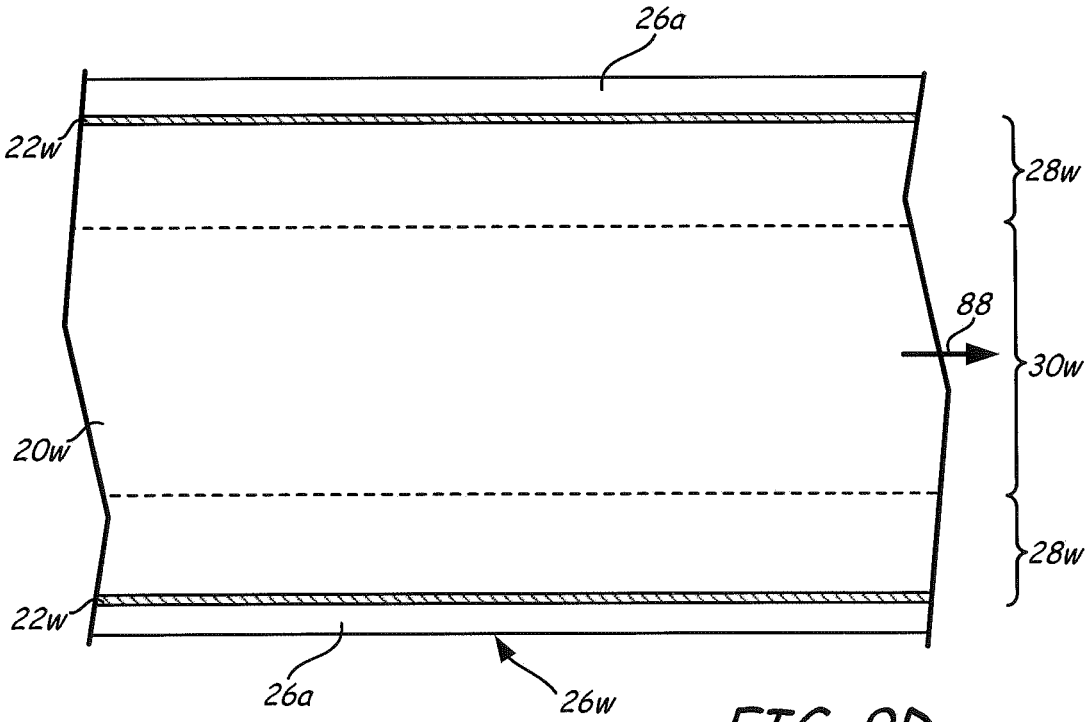

As shown in FIG. 9D, a web of the elastomeric material(s) of elastic layer 20 (referred to as elastic web 20*w*) may then be laminated over support strips 22*w* and the central region of liner web 26*w*. For instance, elastic web 20*w* may be extruded and heat sealed to support strips 22*w* with a heated nip roller or a heated die press. The heat sealing preferably provides good heat seal bonds at support strips 22*w* that prevent delamination under normal conditions of use.

In alternative embodiments, tie layers may be used to provide adhesive bonding between elastic web 20*w* and support strips 22*w*, in addition to, or as an alternative to heat sealing. In further alternative embodiments, other suitable sealing techniques, such as ultrasonic sealing, may be used. The lamination of elastic web 20*w* may also expose the edges of support strips 22*w*, as shown in FIG. 9D. As mentioned above, this may assist in relaxing manufacturing tolerances for laminating elastic web 20*w*.

Figure 9E:
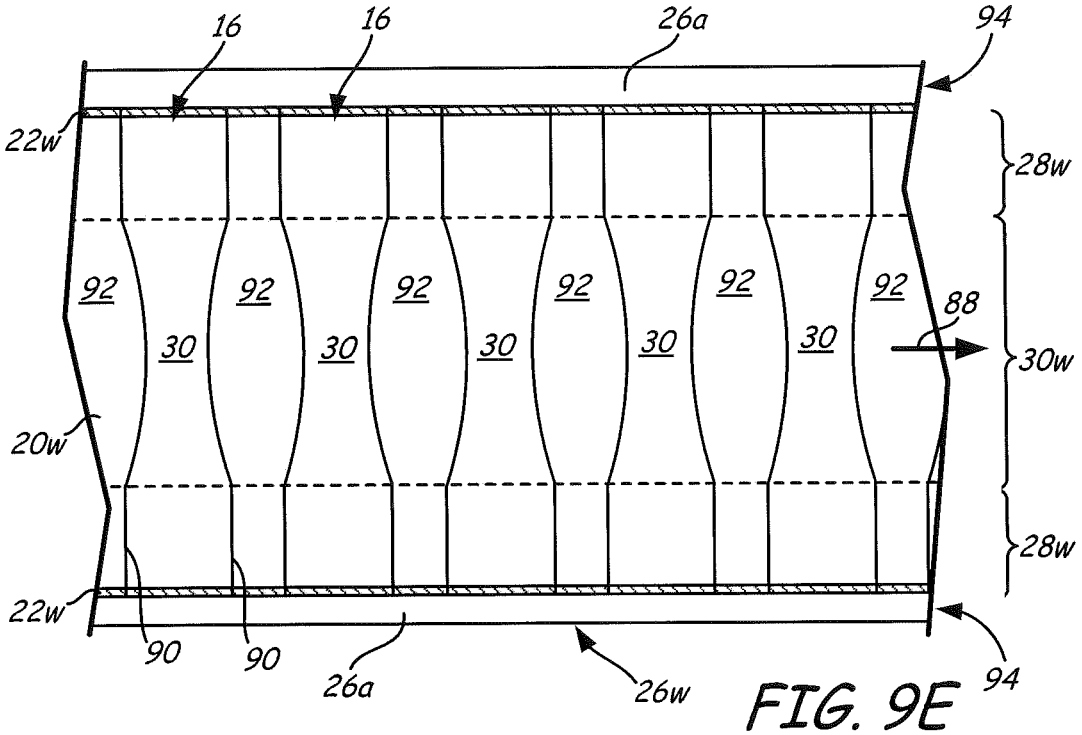

As further shown, once elastic web 20*w* is laminated, the resulting web assembly has web-based anchor strips 28*w* corresponding to anchor regions 28, and a web-based bridging strip 30*w* corresponding to bridging segment 30. As shown in FIG. 9E, the individual elastic bands 16 may then be formed from the web assembly with the use of cut lines 90 (or lines of weakness) that extend perpendicular to the moving direction of the web, and preferably do not extend into liner web 26*w*. This also defines the neck shapes of each bridging segment 30, which are separated by excess matrix 92 between adjacent elastic bands 16. The resulting web with multiple elastic bands 16 may then be provided as a sheet, or more preferably, in a rolled configuration (i.e., as a roll of connected elastic bands 16), for subsequent transportation, storage, purchase, and use.

Figure 9F:
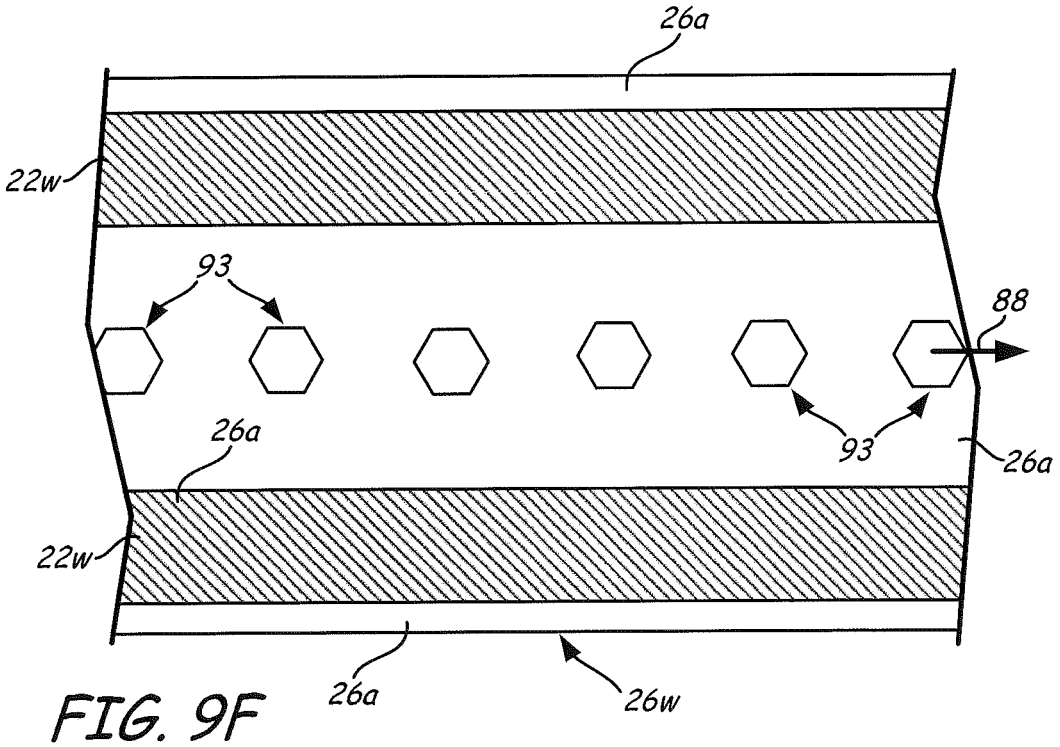

FIGS. 9A-9E illustrate a web-based process that manufactures multiple elastic bands 16 in a single row. Alternatively, the same web-based process may be applied to manufacture multiple elastic bands 16 in two or more adjacent rows. FIG. 9F illustrates another alternative step for producing multiple elastic bands 16, where line web 26*w* is die cut to produce holes 93, such as for individually-tailored designs. This die cutting step may be performed at any suitable time prior to producing elastic web 20*w*. As such, when the elastomer material for elastic web 20*w* is laminated against liner web 26*w*, a portion of the elastomer material fills into holes 93. This produces raised designs above the plane of bridging segment 30 for each elastic band 16.

Figure 13A:
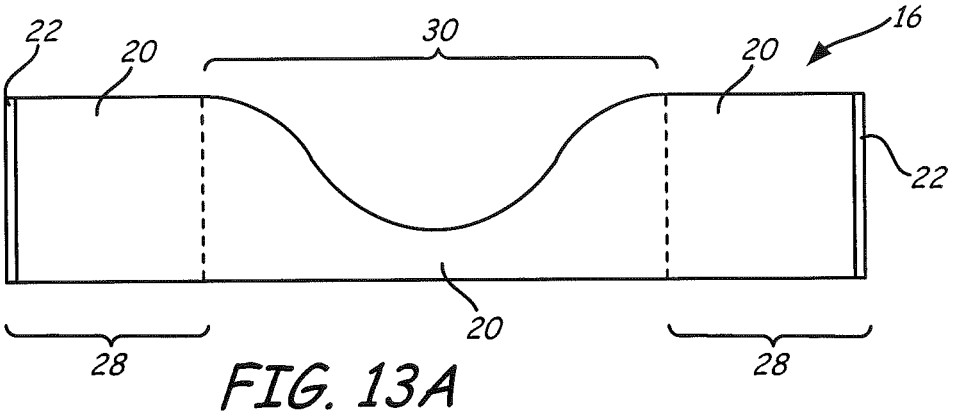
FIG. 13A is a front view of a fourth alternative elastic band of the labeling sleeve assembly, which includes a bridging segment that has edge geometries that are individually tailored, prior to being affixed to the label strap.
Figure 13B:
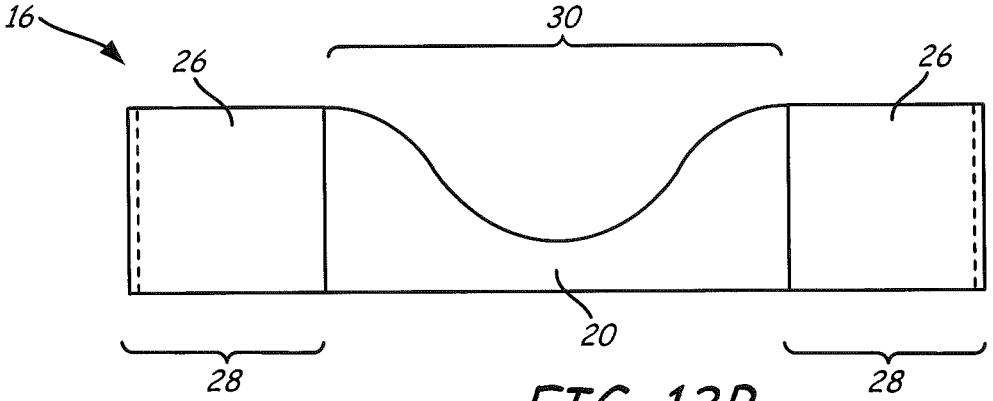
FIG. 13B is a rear view of the fourth alternative elastic band of FIG. 13A.
Figure 13C:
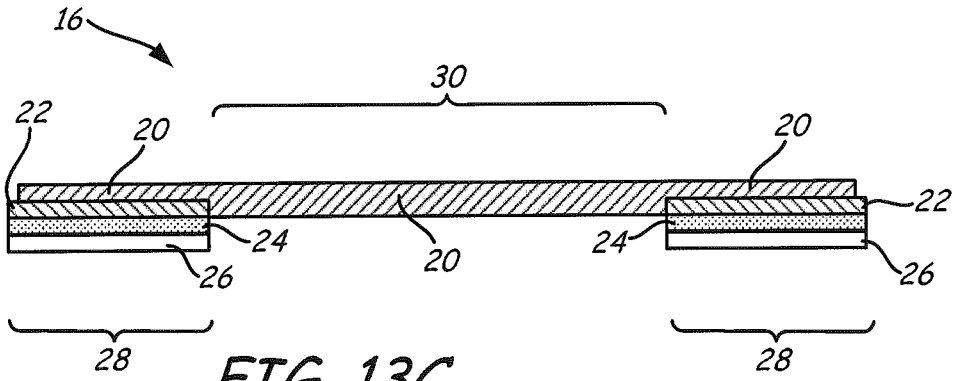
FIG. 13C is a side view of the fourth alternative elastic band of FIG. 13A, with separate layers distinguished by hatching for ease of visibility.
Figure 14A:
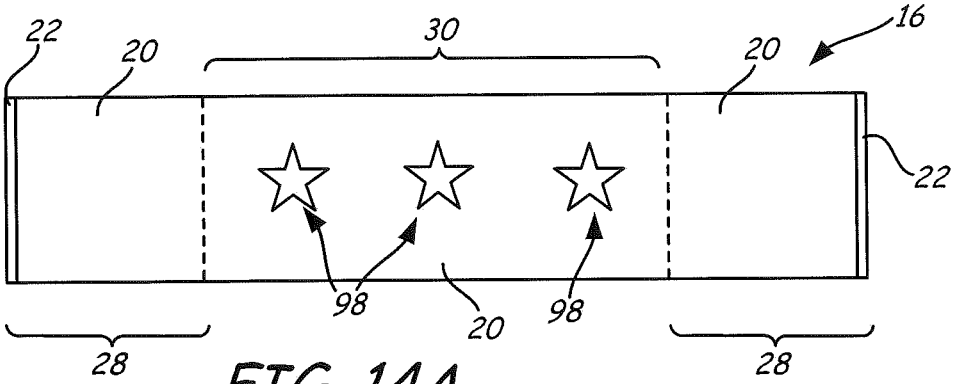
FIG. 14A is a front view of a fifth alternative elastic band of the labeling sleeve assembly, which includes a bridging segment with individually-tailored cut out holes, prior to being affixed to the label strap.
Figure 14B:
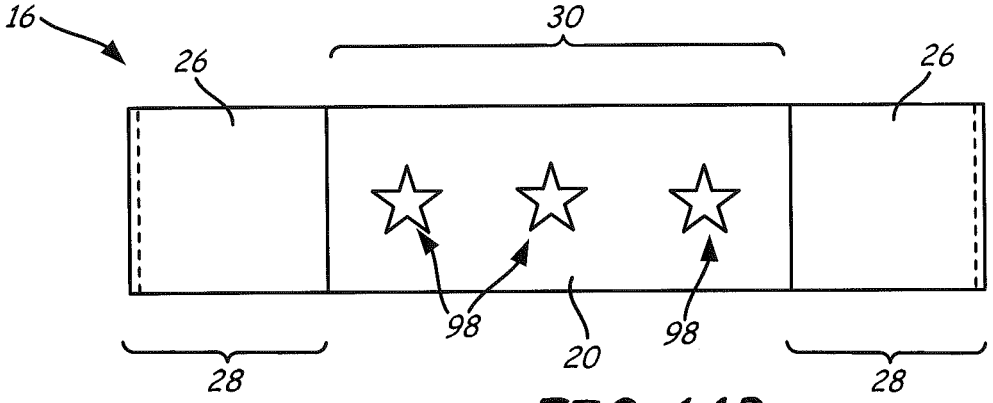
FIG. 14B is a rear view of the fifth alternative elastic band of FIG. 14A.
Figure 14C:
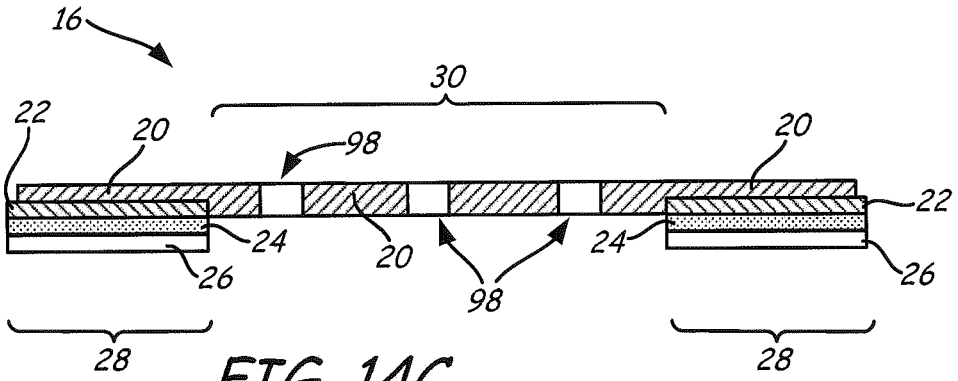
FIG. 14C is a side view of the fifth alternative elastic band of FIG. 14A, with separate layers distinguished by hatching for ease of visibility.

Alternatively, as shown in FIGS. 13A-13C, bridging segment 30 may be cut to have dimensions and shapes that vary along its length, such as a sinusoidal pattern, widths that vary along the length, individually-tailored designs (e.g., brand logos), and the like. Furthermore, as shown in FIGS. 14A-14C, bridging segment 30 may be cut to include a variety of different interior holes (e.g., star-shaped holes 98), such as for individually-tailored designs. Various combinations of these different embodiments may also be used to individually tailor bridging segment 30 to attain a desired elastic and/or aesthetic properties.

In some embodiments, the central region of liner web 26*w* between anchor strips 28*w* (i.e., below bridging strip 30*w*), and/or the lateral-edge portions of liner web 26*w* (referred to as lateral edge portions 94, shown in FIG. 9E), may also be removed. Instead, the remaining strips of liner web 26*w* at anchor regions 28 may remain intact to support a roll or sheet of the scored or cut elastic bands 16.

Figure 10A:
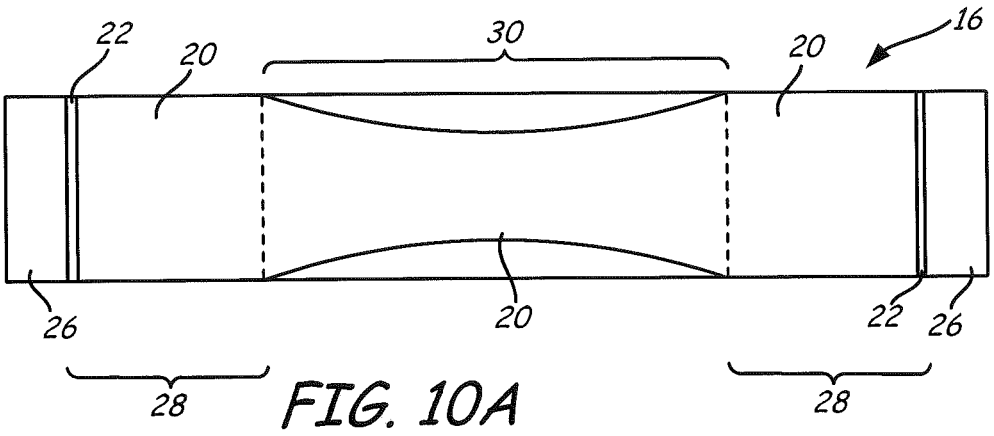
FIG. 10A is a front view of a first alternative elastic band of the labeling sleeve assembly, which includes an extended liner, prior to being affixed to the label strap.
Figure 10B:
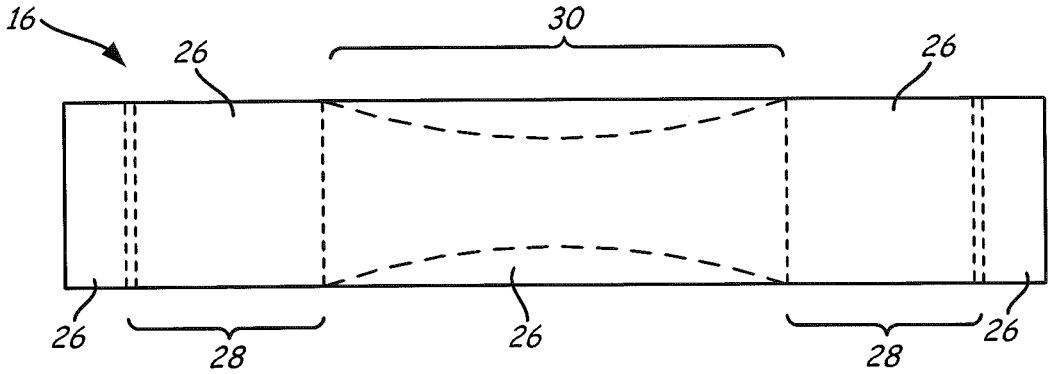
FIG. 10B is a rear view of the first alternative elastic band of FIG. 10A.
Figure 10C:
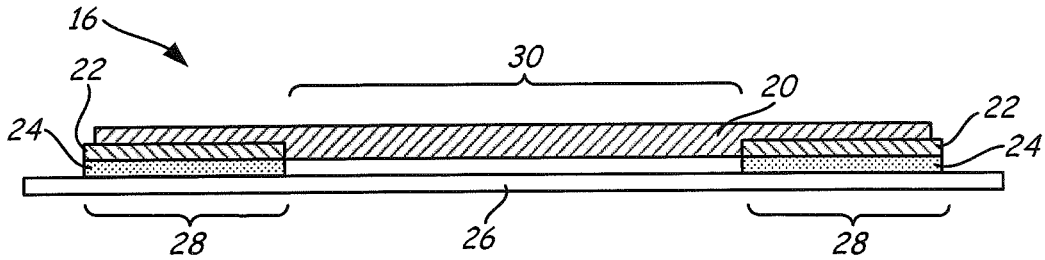
FIG. 10C is a side view of the first alternative elastic band of FIG. 10A, with separate layers distinguished by hatching for ease of visibility.

However, in some embodiments, these portions of liner web 26*w* may remain attached the resulting web assembly. This allows the web to be maintained in roll or sheet form. For example, as shown in FIGS. 10A-10C, in this alternative embodiment, a single liner 26 may also connect anchor regions 28 below bridging segment 30 of elastic layer 20. During use, liner 26 may then be removed from adhesive layers 24 as a single strip in the same manner as discussed above for the separate liners 26.

Figure 10D:
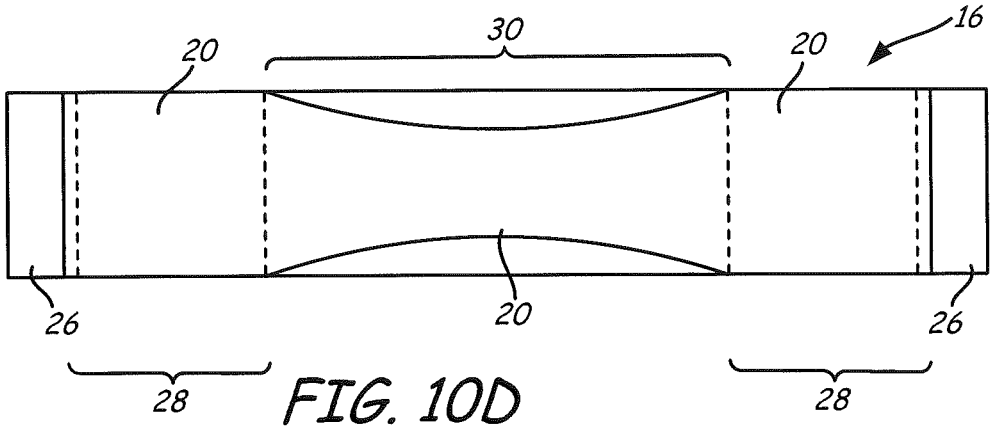
FIG. 10D is a front view of a variant to the first alternative elastic band of the labeling sleeve assembly, which includes an extended liner, prior to being affixed to the label strap, and where the elastic layer extends laterally around the anchor regions.
Figure 10E:
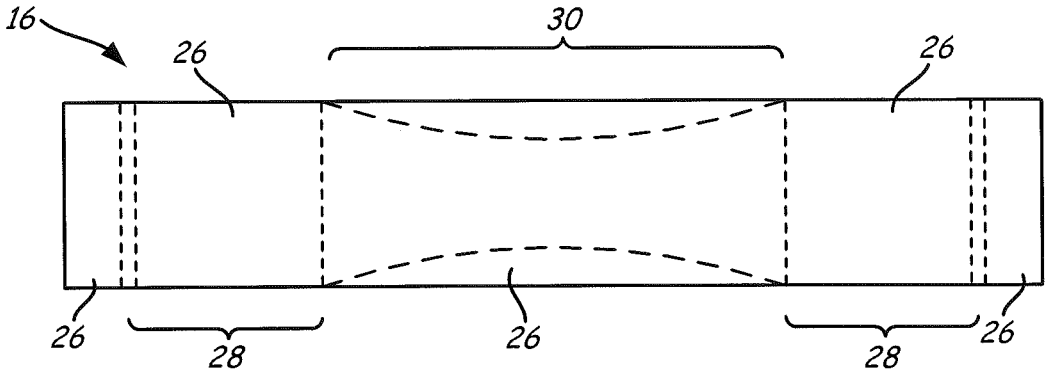
FIG. 10E is a rear view of the first alternative elastic band of FIG. 10D.
Figure 10F:
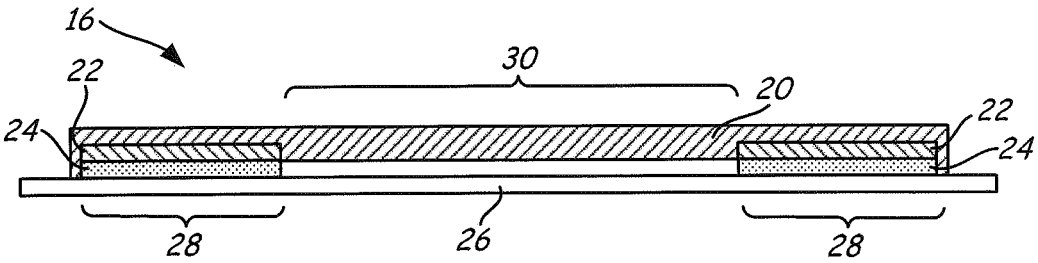
FIG. 10F is a side view of the first alternative elastic band of FIG. 10D, with separate layers distinguished by hatching for ease of visibility.
Figure 10G:
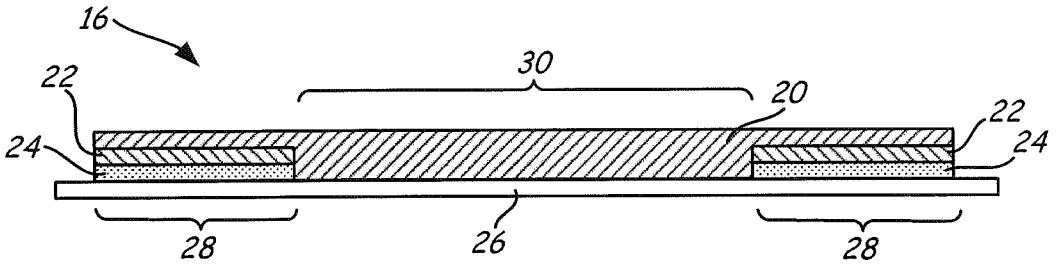
FIG. 10G is a side view of a variant of the first alternative elastic band of FIG. 10C, with separate layers distinguished by hatching for ease of visibility, and where the bridging segment of the elastic layer extends down to contact the liner.
Figure 10H:
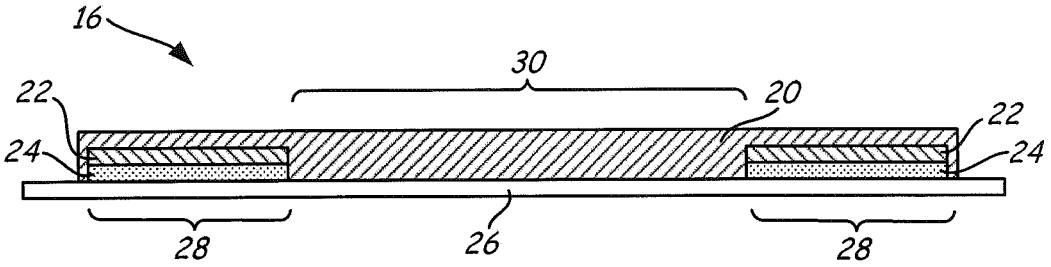
FIG. 10H is a side view of a variant of the first alternative elastic band of FIG. 10F, with separate layers distinguished by hatching for ease of visibility, and where the bridging segment of the elastic layer extends down to contact the liner.

Alternatively, as shown in FIGS. 10D-10F, which illustrate a variant of the elastic band 16 shown in FIGS. 10A-10C, elastic layer 20 may also extend laterally around the ends of anchor regions 28 to encase the ends of support layer 22 and adhesive layer 24. In further variants, as shown in FIG. 10G (corresponding to FIG. 10C) and FIG. 10H (corresponding to FIG. 10F), bridging segment 30 of elastic layer 20 may alternatively extend down to contact liner 26.

Figure 11A:
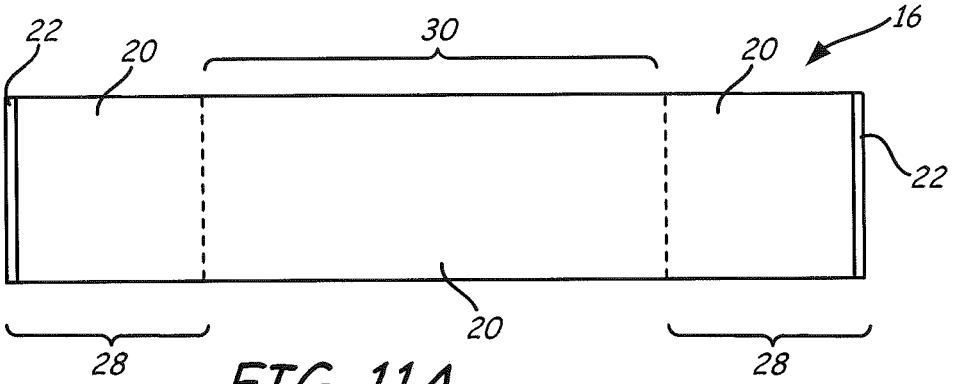
FIG. 11A is a front view of a second alternative elastic band of the labeling sleeve assembly, which includes a non-necked bridging segment, prior to being affixed to the label strap.
Figure 11B:
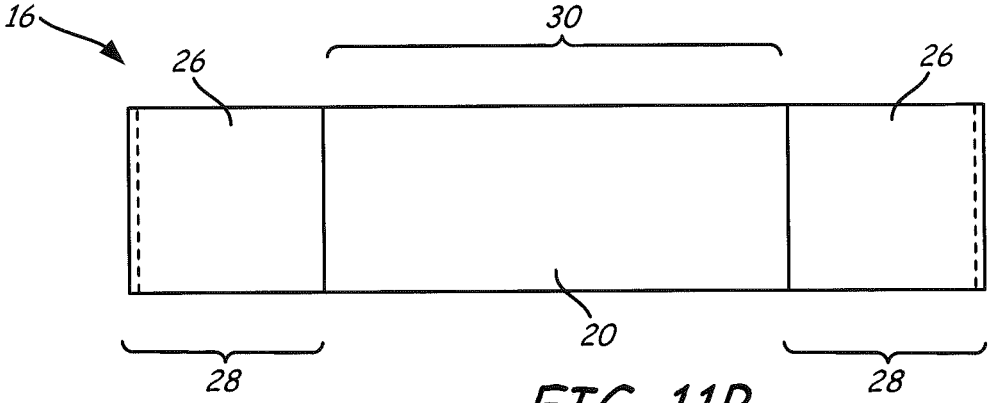
FIG. 11B is a rear view of the second alternative elastic band of FIG. 11A.
Figure 11C:
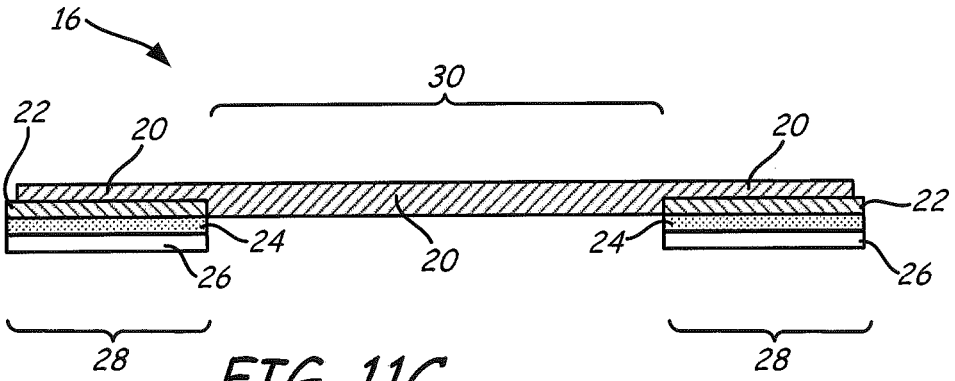
FIG. 11C is a side view of the second alternative elastic band of FIG. 11A, with separate layers distinguished by hatching for ease of visibility.

FIGS. 11A-11C illustrate another alternative embodiment for elastic band 16, in which elastic layer 20 at bridging segment 30 is not necked. In this embodiment, bridging segment 30 will have different elastic properties compared to those of bridging segment 30 as shown in FIGS. 2A-2C, typically requiring greater stretching loads to stretch the bridging segment 30. Accordingly, bridging segment 30 may cut to any desired shape (or remain uncut) to attain a desired elastic property.

Figure 12A:
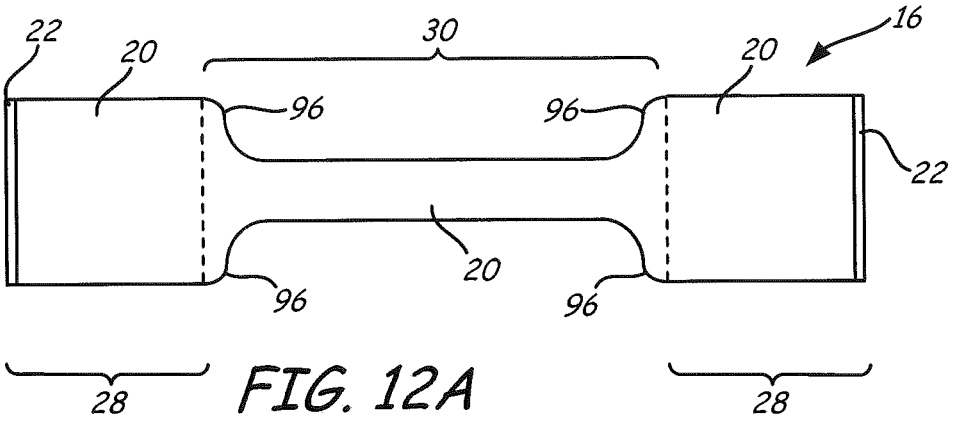
FIG. 12A is a front view of a third alternative elastic band of the labeling sleeve assembly, which includes necked and shouldered bridging segment, prior to being affixed to the label strap.
Figure 12B:
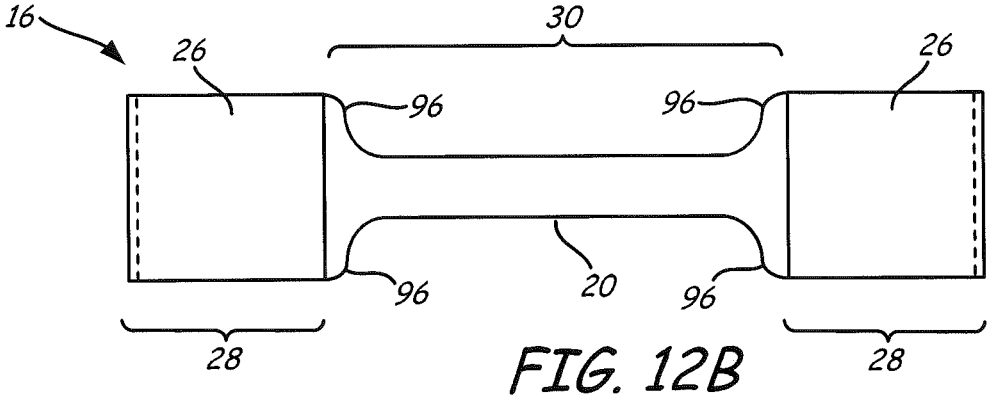
FIG. 12B is a rear view of the third alternative elastic band of FIG. 12A.
Figure 12C:
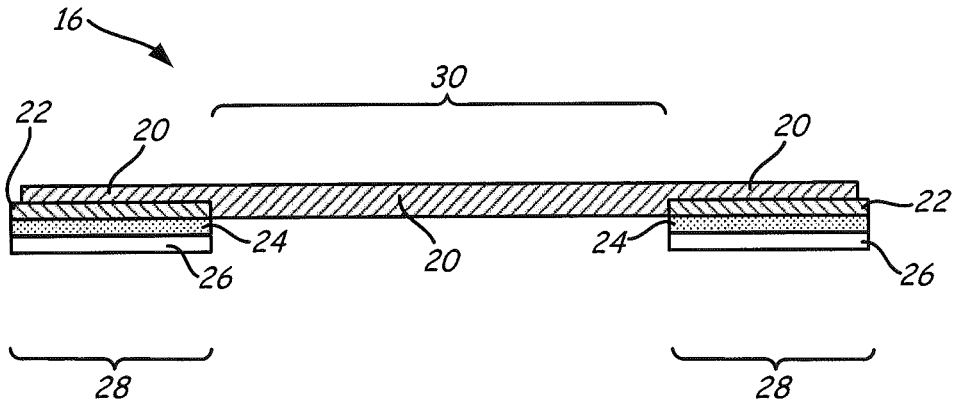
FIG. 12C is a side view of the third alternative elastic band of FIG. 12A, with separate layers distinguished by hatching for ease of visibility.

For instance, as shown in FIGS. 12A-12C, bridging segment 30 may be cut to include opposing shoulders 96 between the necked portion. In this embodiment, shoulders 96 may further reduce the stress loads applied to anchor regions 28 by laterally distributing the stress loads. Alternatively, as shown in FIGS. 13A-13C, bridging segment 30 may be cut to have dimensions and shapes that vary along its length, such as a sinusoidal pattern, widths that vary along the length, individually-tailored designs (e.g., brand logos), and the like. Furthermore, as shown in FIGS. 14A-14C, bridging segment 30 may be cut to include a variety of different interior holes (e.g., star-shaped holes 98), such as for individually-tailored designs. Various combinations of these different embodiments may also be used to individually tailor bridging segment 30 to attain a desired elastic and/or aesthetic properties.

Figure 15A:
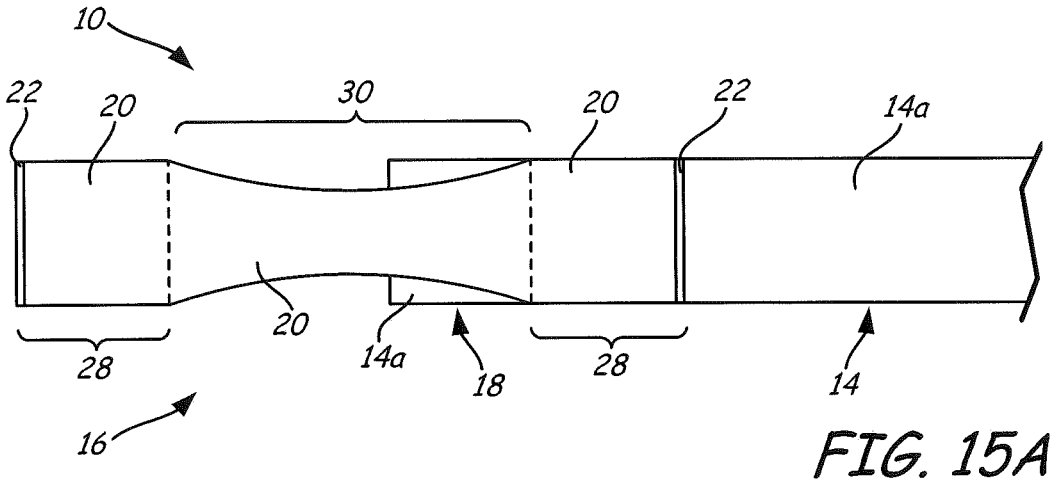
FIG. 15A is a front view of an alternative labeling sleeve assembly, which includes the label strap attached to the elastic band prior to use.
Figure 15B:
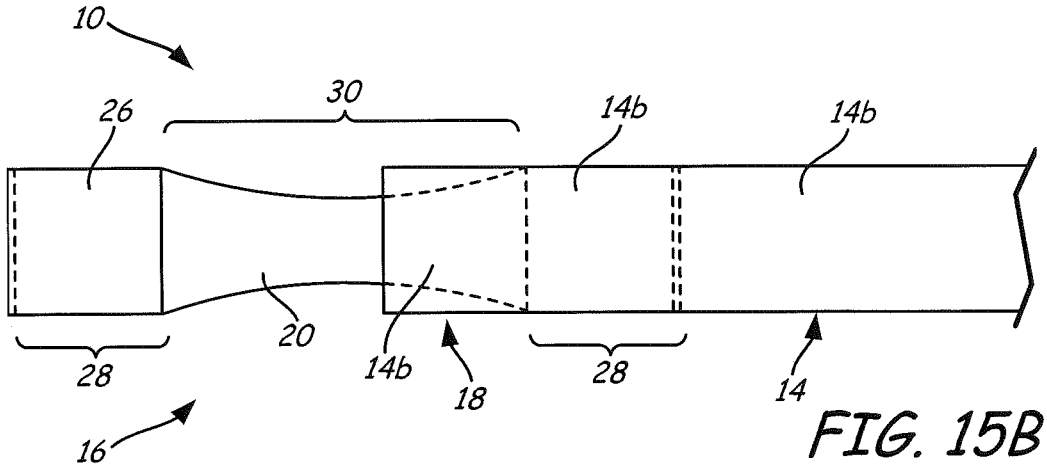
FIG. 15B is a rear view of the alternative labeling sleeve assembly of FIG. 15A.
Figure 15C:
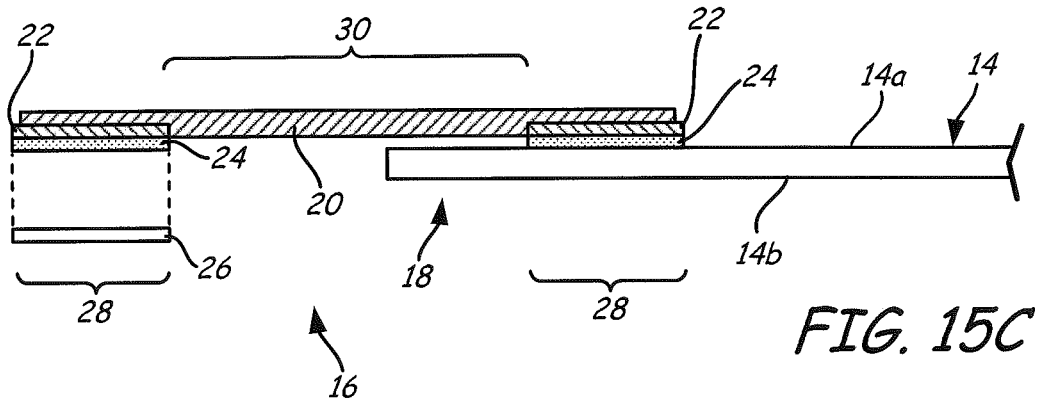
FIG. 15C is a side view of the alternative labeling sleeve assembly of FIG. 15A, with separate layers distinguished by hatching for ease of visibility.

FIGS. 15A-15C illustrate an alternative to labeling sleeve assembly 10, in which label strap 14 is connected to one of the anchor regions 28 of elastic band 16 prior to use. In particular, label strap 14 may be adhered to one of the adhesive layers 24 such that end segment 18 of label strap 14 extends below bridging segment 30. This allows the opposing end segment 18 to overlap with the adhered end segment 18 when label strap 14 is folded into loop 34, as discussed above.

The opposing anchor region 28 may retain liner 26 in the same manner as discussed above. During use, label strap 14 may be formed into loop 34, where one of the end segments 18 is already adhered to one of the anchor region 28. For example, liner 26 may be removed from the non-adhered anchor region 28, and the exposed adhesive layer 26 may then be adhered to the available end segment 18 in the same manner as discussed above.

In an alternative embodiment, one or both of support layer 22 and adhesive layer 24 that are shown connected to label strap 14 in FIGS. 15A-15C may be omitted, such that the same end segment 18 may be bonded (e.g., heat sealed) directly to elastic layer 20 at the anchor region 28. In a further alternative embodiment, this anchor region 28 may be mechanically connected to the end segment 18 of label strap 14, such as with a mechanical fastener.

Labeling sleeve assembly 10 of the embodiment shown in FIGS. 15A-15C may be manufactured in a variety of manners. For instance, in one embodiment, the manufacturing process may involve a two-stage technique, where label strap 14 and elastic band 16 may be manufactured separately, and then adhered or otherwise bonded together to produce labeling sleeve assembly 10 as shown in FIGS. 15A-15C.

Figure 16A:
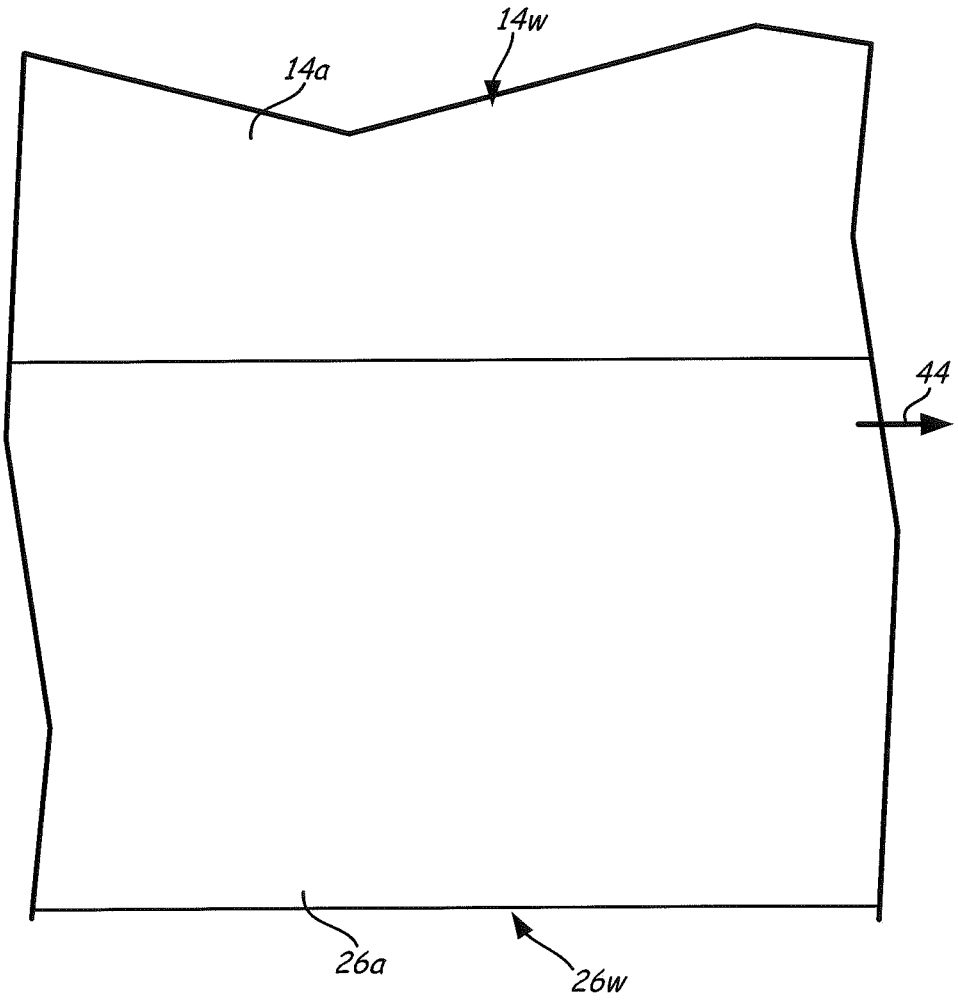
FIGS. 16A and 16B are schematic illustrations of an example web-based process for manufacturing multiple alternative labeling sleeve assemblies as shown in FIGS. 15A-15C.
Figure 16B:
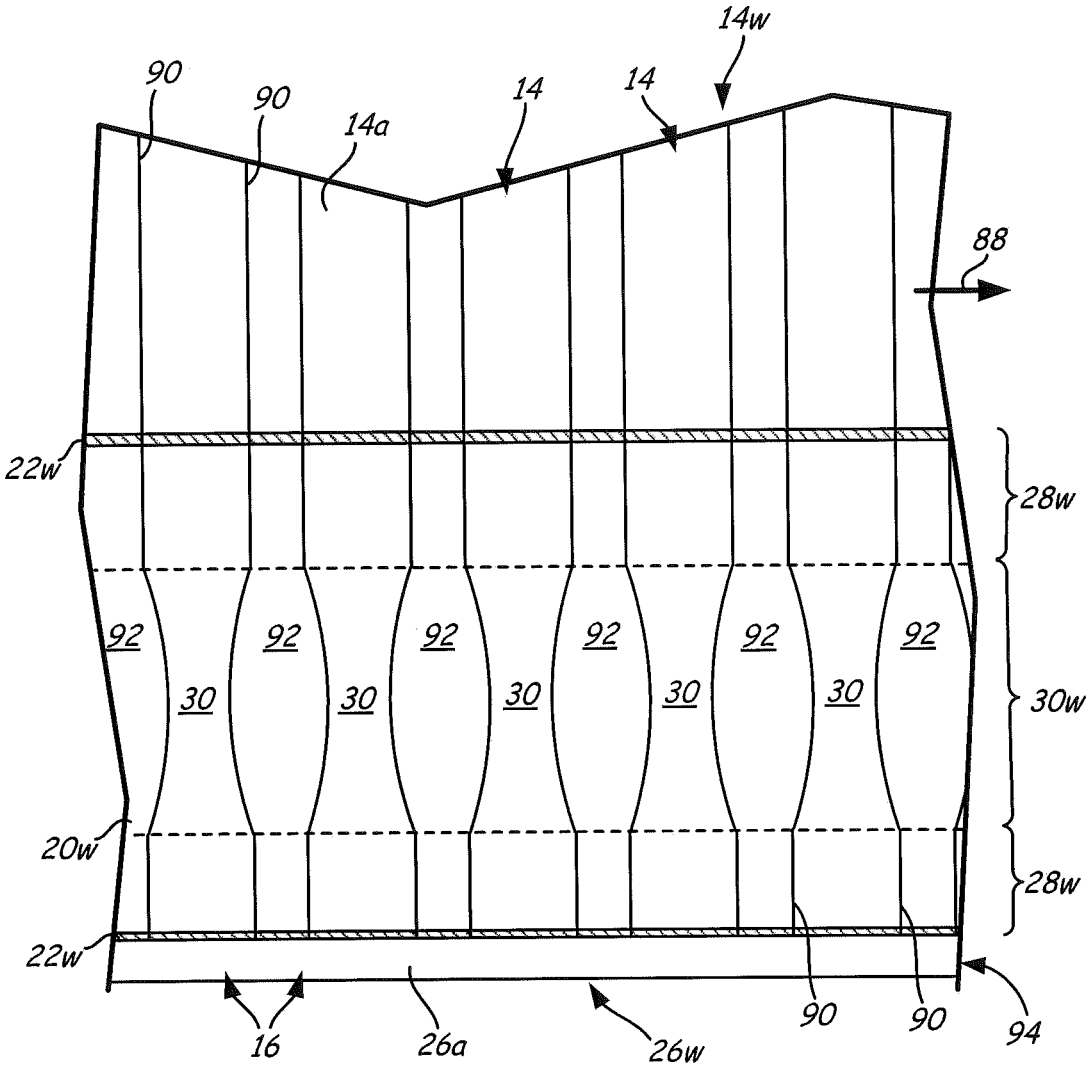

Alternatively, as shown in FIGS. 16A and 16B, labeling sleeve assembly 10 of the embodiment shown in FIGS. 15A-15C may be manufactured using a web-based process that is similar to the process discussed above for FIGS. 9A-9E. As such, in this embodiment, label strap 14 may be adhered or otherwise bonded to elastic band 16 during the same process that is used to manufacture elastic band 16.

For example, as shown in FIG. 16A, a web of the material(s) for label strap 14 (referred to as label web 14*w*) may be positioned adjacent to the liner web 26*w* such that their respective edges abut one another, but do not overlap. In an alternative embodiment, label web 14*w* may partially overlap on top of liner web 26*w*, which may assist in maintaining proper registration between the webs during the manufacturing process, and for maintaining the resulting web assembly in roll or sheet form.

The remaining steps discussed above for FIGS. 9B-9D may then be performed to produce anchor regions 28 connected by bridging segment 30. As shown in FIG. 16B, once elastic web 20*w* is laminated, the resulting web assembly has web-based anchor strips 28*w* corresponding to anchor regions 28, and a web-based central strip 30*w* corresponding to bridging segment 30. The individual labeling sleeve assemblies 10 may then be formed from the web assembly with the use of cut lines 90 (or lines of weakness) that extend perpendicular to the moving direction of the web. This also defines the neck shapes of each bridging segment 30, which are separated by excess matrix 92 between adjacent elastic bands 16. The resulting web with multiple labeling sleeve assemblies 10 may then be provided as a sheet, or more preferably, in a rolled configuration (i.e., as a roll of connected labeling sleeve assemblies 10), for subsequent transportation, storage, display, purchase, and customer use.

In some preferred embodiments, cut lines 90 do not extend through liner web 26*w*. This may assist in maintaining the resulting web in a roll form that is feedable to an automated system for removing individual labeling sleeve assemblies 10 from the roll, and securing them to article(s) as discussed above. For instance, labeling sleeve assembly 10 of the embodiment shown in FIGS. 16A and 16B is particularly suitable for being secured to articles pursuant to the second technique discussed above for FIGS. 4A-4F, where the steps shown in FIGS. 4A and 4B may be omitted because label strap 14 is already bonded to one of the anchor regions 28.

Figure 17A:
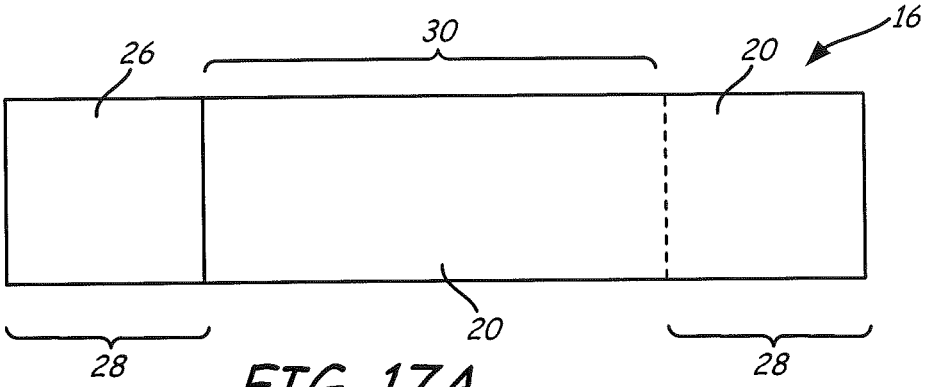
FIG. 17A is a front view of a sixth alternative elastic band of the labeling sleeve assembly, which includes opposing anchor regions, prior to being affixed to the label strap.
Figure 17B:
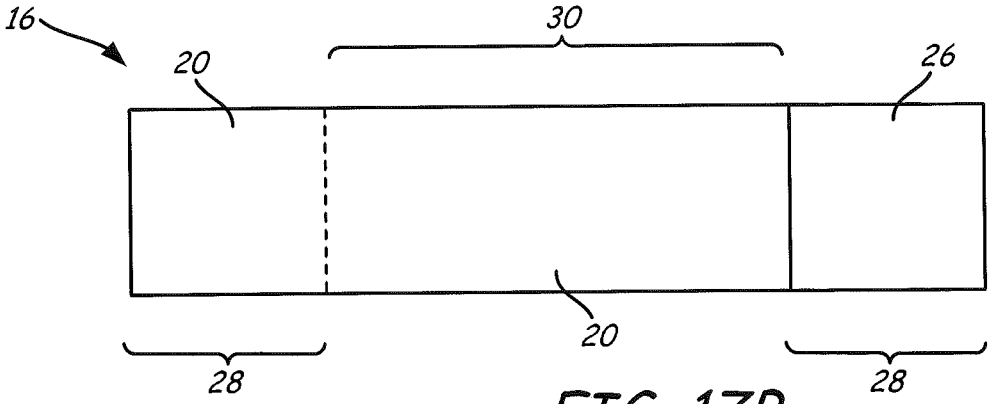
FIG. 17B is a rear view of the sixth alternative elastic band of FIG. 17A.
Figure 17C:
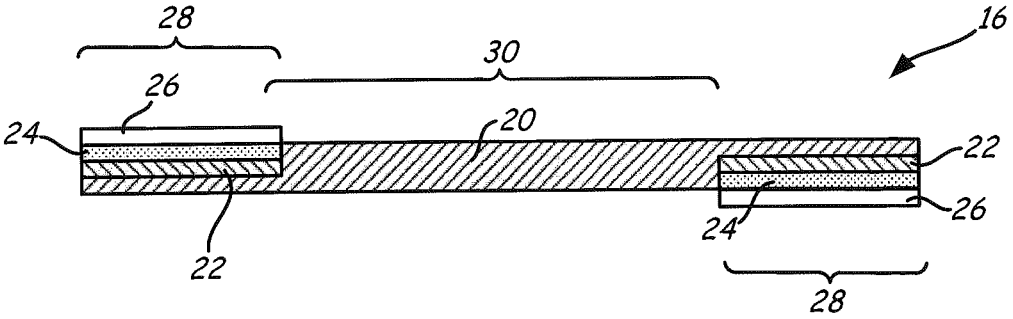
FIG. 17C is a side view of the sixth alternative elastic band of FIG. 17A, with separate layers distinguished by hatching for ease of visibility.
Figure 17D:
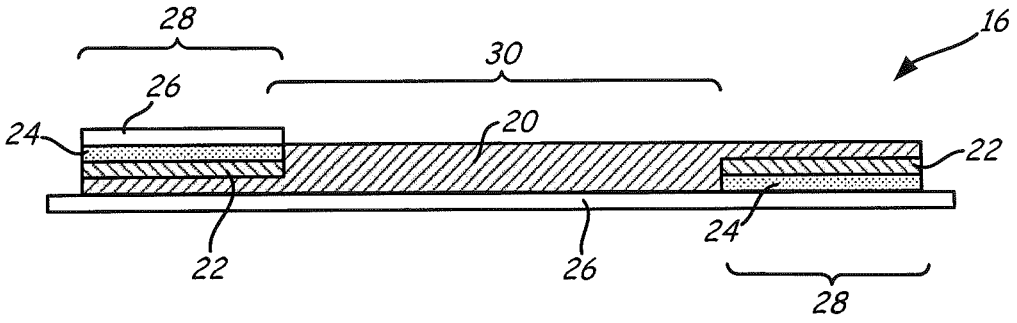
FIG. 17D is a side view of a second aspect of the sixth alternative elastic band of FIGS. 17A-17C, with separate layers distinguished by hatching for ease of visibility, and which includes a shortened front liner.
Figure 17E:
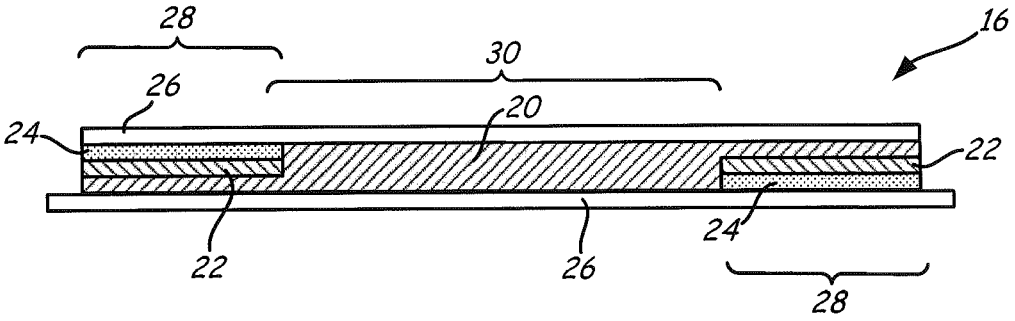
FIG. 17E is a side view of a third aspect of the sixth alternative elastic band of FIGS. 17A-17C, with separate layers distinguished by hatching for ease of visibility, and which includes shortened front and rear liners.

FIGS. 17A-17C illustrate another alternative embodiment for elastic band 16, in which the anchor regions 28 face opposing sides of elastic band 16. In particular, this arrangement has a front-facing adhesive layer 24, and a rear-facing adhesive layer 24. As further shown, a pair of liners 26 also face opposing sides of elastic band 16 and are sized to cover adhesive layers 24. Alternatively, the rear-side liner 26 may extend across elastic band 16 (as shown in FIG. 17D) and/or the front-side liner 26 may extend across elastic band 16 (as shown in FIG. 17E).

As shown in FIGS. 18 and 18B, elastic band 16 with the opposing-faced adhesive layers 24 may be secured to label strap 14 in a similar manner as the above-discussed elastic bands 16 (e.g., as shown in FIGS. 1A-16B). However, in this case, elastic band 16 may be secured between end segments 18 of label strap 14, thereby remaining hidden (e.g., as shown by dashed lines in FIG. 18A).

During use, label strap 14 may be partially shaped into loop 34 around article 12, as discussed above. The rear-facing adhesive layer 24 may then be secured to display surface 14*a* of label strap 14 at any suitable location along lower end segment 18. Upper end segment 18 may then be pulled and pressed against the front-facing adhesive layer 24 to secure the front-facing adhesive layer 24 to rear surface 14*b* of label strap 14. As shown, the front-facing adhesive layer 24 is preferably secured along the upper end segment 18 at a location that allows the upper end segment 18 to hide elastic band 16.

When adhered in this manner, the tension applied to label strap 14 (as illustrated by arrows 40*a* and 40*b*) pulls anchor regions 28 in opposing directions under shear (as illustrated by arrows 42), thereby stretching bridging segment 30. This is achievable because of the bonding locations of the adhesive layers 24 to end segments 18. In particular, the rear-facing adhesive layer 24 is secured to display surface 14*a* at an inward location along label strap 14 in the direction of arrow 40*a* relative to the front-facing adhesive layer 24. Correspondingly, the front-facing adhesive layer 24 is secured to rear surface 14*b* at an inward location along label strap 14 in the direction of arrow 40*b* relative to the rear-facing adhesive layer 24. This arrangement allows bridging segment 30 to stretch in the opposing directions of arrows 42 to hold label strap 14 closed as loop 34 around the article 12 under elastic tension.

In comparison, as shown in FIG. 18C, if the locations of adhesive layers 24 were reversed, the tension applied to label strap 14 (as illustrated by arrows 40*a* and 40*b*) would undesirably pull anchor regions 28 towards each other (as illustrated by arrows 43), thereby contracting bridging segment 30. This accordingly would reduce the elastic tension applied to label strap 14, which could increase the size of loop 34 and potentially allow label strap 14 to slide or otherwise fall off of the article 12. Thus, the arrangement shown above in FIG. 18B achieves a unique mechanism to hold label strap 14 closed, as loop 34 extends around the article 12 under elastic tension.

Figure 19A:
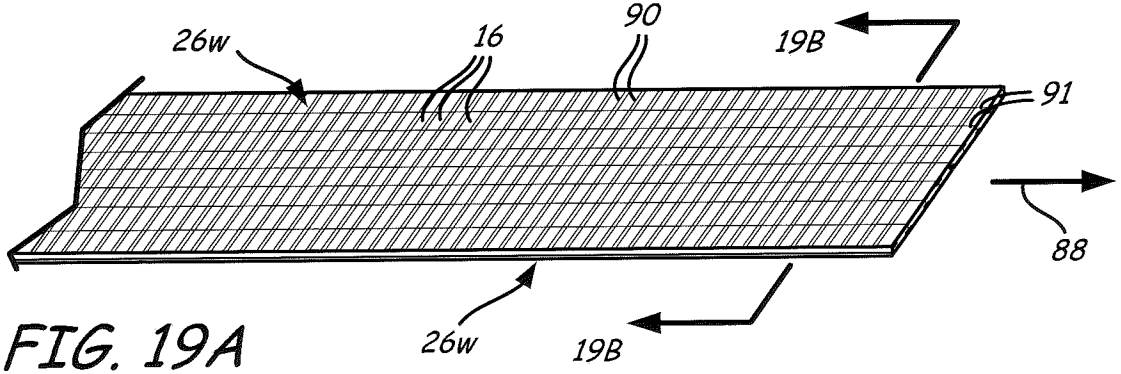
FIGS. 19A-19E are schematic illustrations of an example web-based process for manufacturing multiple elastic bands of the present disclosure.
Figure 19B:
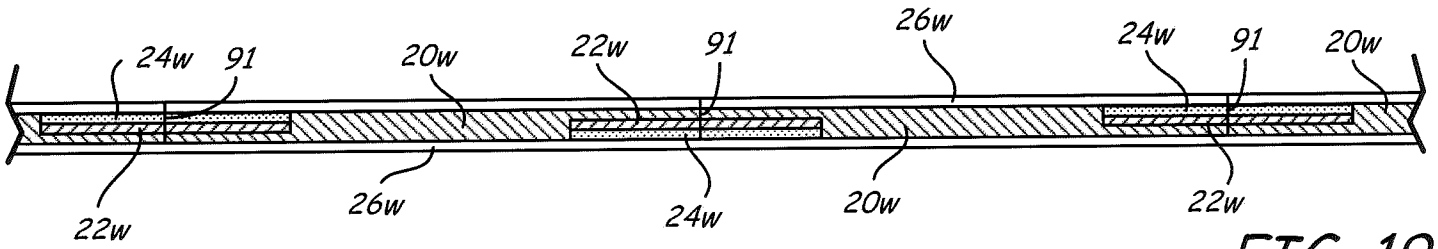

The elastic band 16 with the opposing anchor regions 28, such as illustrated in FIGS. 17A-18C, may be manufactured in a similar manner to that discussed above (e.g., as shown in FIGS. 9A-9F). For example, as shown in FIGS. 19A and 19B, multiple elastic bands 16 may be produced by co-laminating adhesive strips 24*w* and support strips 22*w* with elastomer web 20*w* and a pair of opposing liner webs 26*w*. In this case, as best shown in FIG. 19B, adhesive strips 24*w* and support strips 22*w* are introduced in alternating arrangements to provide the opposing anchor regions 28. In some embodiments, adhesive strips 24*w* and support strips 22*w* may be provided together as a label stock, as discussed above.

Figure 19C:
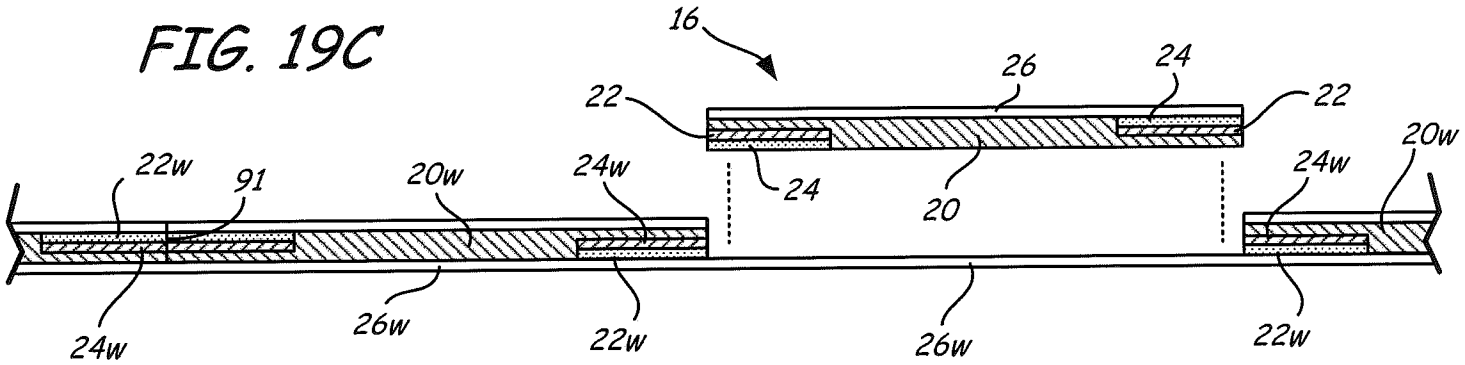

In the example shown in FIGS. 19A-19C, multiple elastic bands 16 may be produced in multiple adjacent rows (as well as along the length of the web assembly). Furthermore, the individual elastic bands may be separated by cut lines 91 (or lines of weakness) that extend parallel to the moving direction of the web, and preferably do not extend into rear-side liner web 26*w*. This is in addition to the cut lines 90 (or lines of weakness) that extend perpendicular to the moving direction of the web, as discussed above. During use, each individual elastic band 16 may then be removed, manually or with an automated system, from the bottom liner 26*w* and secured to a label strap 14, as discussed above.

Figure 19D:
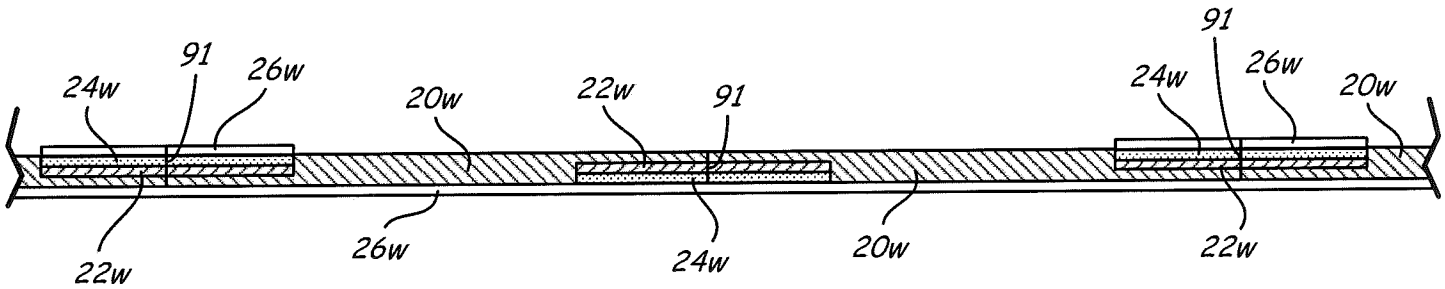
Figure 19E:
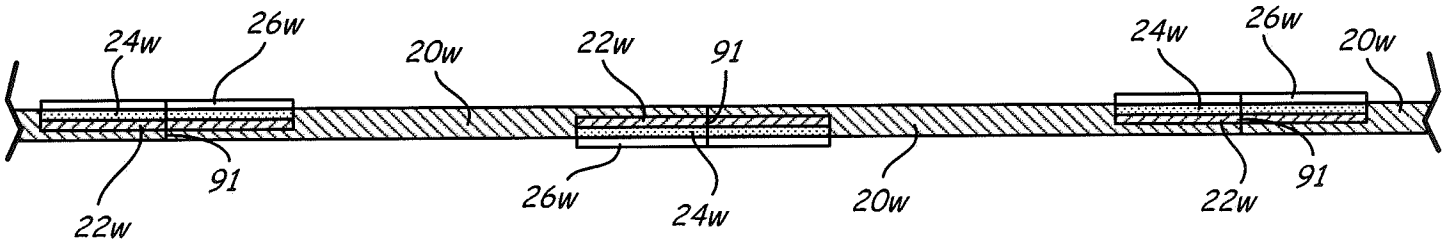

FIGS. 19D and 19E illustrate alternative arrangements for elastic bands 16. For instance, as shown in FIG. 19D, the front-side liner web 26*w* may be co-laminated in separate strips that cover the front-facing adhesive strips 24*w*. Similarly, as shown in FIG. 19E, the rear-side liner web 26*w* may also be co-laminated in separate strips that cover the rear-facing adhesive strips 24*w*.

Figure 20:
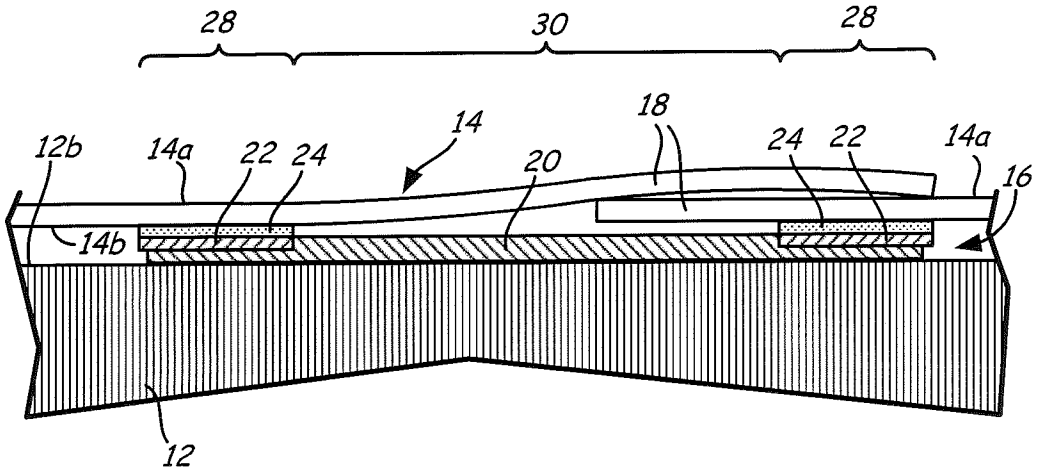
FIG. 20 is a side viewing illustrating an alternative use for an elastic band, in which the elastic band is affixed to a rear surface of a label strap.

The above discussion has been primarily made with reference to elastic bands 16 being affixed to display surface 14*a* of label strap 14, or between end segments 18 of label strap 14. However, in alternative embodiments, such as shown in FIG. 20, elastic band 16 having may be affixed to rear surface 14*b* of label strap 14, such that elastic layer 20 rests against rear side 12*b* of article 12. This embodiment is beneficial for hiding elastic band 16, and is preferably used in conjunction with an article 12 that is not susceptible to oil leaching from elastic layer 20. An additional benefit of this embodiment is that the grippiness of the elastomeric material(s) of elastic band 16 may further prevent the secured labeling sleeve assembly 10 from sliding along article 12.

Figure 21A:
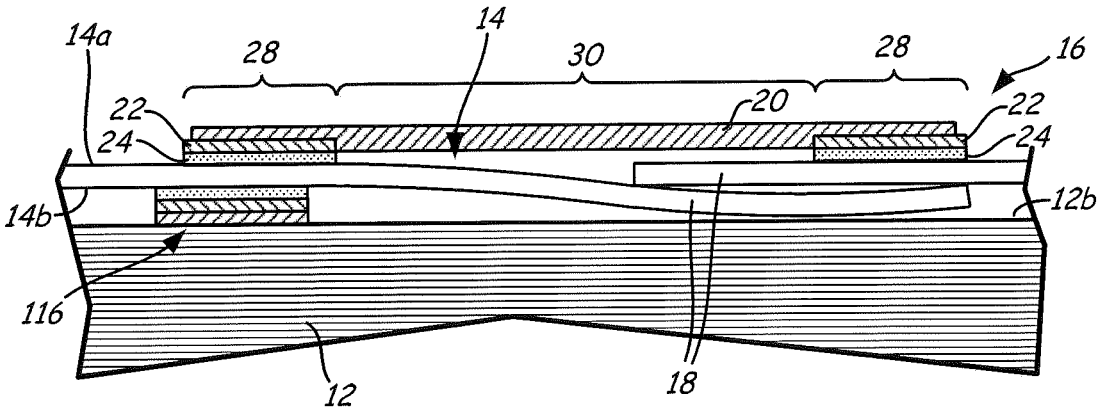
FIG. 21A is a side viewing illustrating a labeling band assembly in use with an article and a button assembly, where the button assembly may be used with or without the labeling band assembly.
Figure 21B:
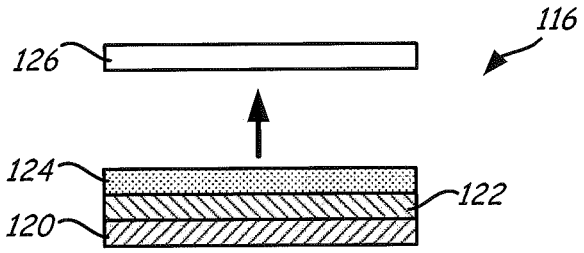
FIG. 21B is a side view of the button assembly.
Figure 21C:
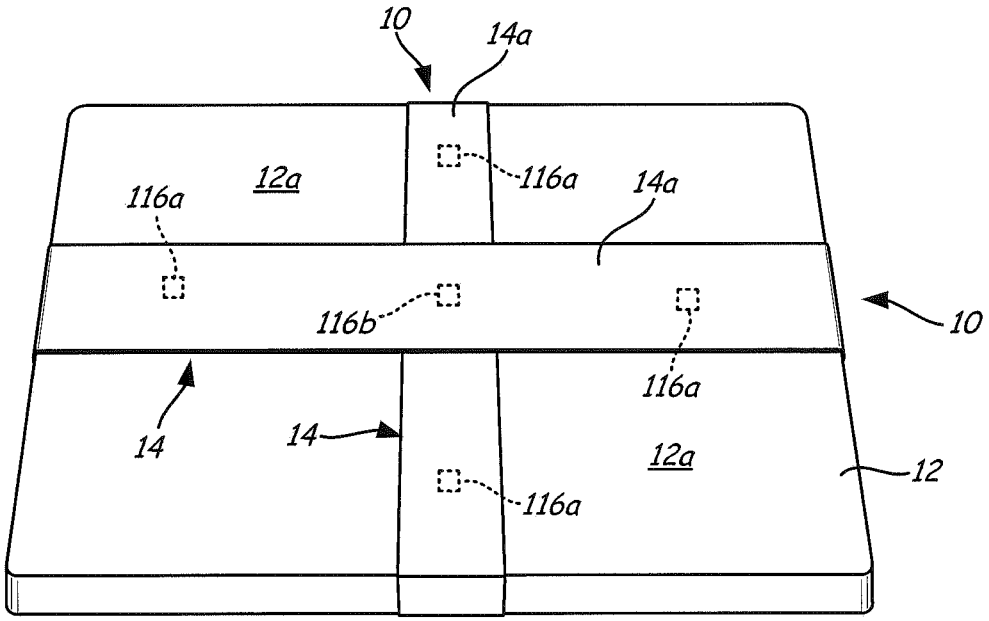
FIG. 21C is a front perspective view of a pair of labeling sleeve assemblies secured around an article with the use of multiple button assemblies.

The grippiness of the elastomeric material(s) may also be employed in a further alternative manner, as shown in FIGS. 21A-21C. As shown in FIG. 21A, in this embodiment, the present disclosure is directed to a button assembly 116, where one or more button assemblies 116 may be affixed to rear surface 14*b* to grip rear surface 12*b* of article 12. Button assembly 116 may be used in conjunction with labeling sleeve assembly 10, or separately (e.g., label strap 14 may be secured closed using other means (e.g., tape).

As shown in FIG. 21B, button assembly 116 includes elastic layer 120, support layer 122, adhesive layer 124, and release liner 126 (which correspond to elastic layer 20, support layer 22, adhesive layer 24, and release liner 26 at a single anchor region 28 of an elastic band 16, such as illustrated in FIG. 2C). Accordingly, button assembly 116 may be produced using the same web-based process as discussed above for elastic band 16, and from the same discussed-above materials.

As can be appreciated, button assembly 116 may be used in a variety of manners to prevent slippage between surfaces. For instance, as shown in FIG. 21C, one or more button assemblies 116*a* may be used to further prevent sliding between article 12 and a pair of labeling sleeve assemblies 10. Furthermore, an additional button assembly 116*b* may be used to prevent sliding between the pair of labeling sleeve assemblies 10. Alternatively, labeling sleeve assemblies 10 may be replaced with standard labels or other wrappings for article 12, where button assemblies 116 (e.g., button assemblies 116*a* and 116*b*) may assist in preventing these labels or wrappings from slipping relative to article 12.

Labeling sleeve assembly 10 of the present disclosure is suitable for use with a variety of different articles, allowing the label straps 14 to display indicia 15 in a prominent manner. The label strap 14 may be folded into any suitable shape for loop 34, preferably with end segments 18 overlapping each other. One or more elastic bands 16 may affixed to the opposing end segments 18 to hold label strap 14 closed as loop 34 around the article(s) under elastic tension.

As discussed above, bridging segments 30 of the elastic bands 16 are preferably the only components of labeling sleeve assembly 10 that stretch when labeling sleeve assembly 10 is expanded from its relaxed state to a stretched state. This prevents the printed indicia 15 on display surface 14*a* of label strap 14 from distorting, and preserves the adhesive bonds between label strap 14 and elastic band(s) 16.

The elastic tension of loop 34 accordingly prevents labeling sleeve assembly 10 from slipping off of the article during normal use, such as during transportation, storage, display, purchase, and customer use. It also allows labeling sleeve assembly 10 to be readily removed from the article(s) without undue effort, providing a low-cost and user-friendly mechanism for displaying information.

The features of the present disclosure are also discussed in U.S. Provisional Patent Application No. 61/877,498 (filed on Sep. 13, 2013) and U.S. Provisional Patent Application No. 61/911,065 (filed on Dec. 3, 2013), the contents of each of which are incorporated by reference. Although the present disclosure has been described with reference to several embodiments, workers skilled in the art will recognize that changes may be made in form and detail without departing from the spirit and scope of the disclosure.

The invention claimed is:

1. A labeling sleeve assembly including:

a substantially non-elastic label strap having a first end segment and a second end segment, wherein the label strap is configured to be formed into a loop; and an elastic band including a first end configured to bond to the first end segment of the label strap, and the elastic band including a second end configured to bond to the second end segment of the label strap, the elastic band including:

an elastic layer having no adhesive thereon between the first and second ends;

a first anchor region disposed at the first end of the elastic band and including:

a first structural support layer disposed against the elastic layer;

a first adhesive layer disposed against the first structural support layer; and a first release liner portion disposed against the first adhesive layer; and a second anchor region disposed at the second end of the elastic band and including:

a second structural support layer disposed against the elastic layer;

a second adhesive layer disposed against the second structural support layer; and a second release liner portion disposed against the second adhesive layer.

2. The labeling sleeve assembly of claim 1, wherein the label strap further includes a first surface and a second opposing surface, wherein the first adhesive layer is configured to bond to the first end segment of the label strap at the first surface, and wherein the second adhesive layer is configured to bond to the second end segment of the label strap at the first surface.

3. The labeling sleeve assembly of claim 2, wherein the first surface comprises printed indicia.

4. The labeling sleeve assembly of claim 1, wherein the first structural support layer comprises a material that is substantially non-elastic.

5. The labeling sleeve assembly of claim 1, wherein the first and second end segments at least partially overlap while the label strap is formed into the loop.

6. The labeling sleeve assembly of claim 1, wherein the label strap further includes a first surface and a second opposing surface, wherein the first adhesive layer is configured to bond to the first end segment of the label strap at the first surface, and wherein the second adhesive layer is configured to bond to the second end segment of the label strap at the second surface.

7. A method for securing the labeling sleeve assembly of claim 1 to one or more articles at an intended placement location, the method including:

forming the label strap into the loop, wherein the loop has an interior perimeter length that is shorter than a length of a footprint perimeter of the article(s) at the intended placement location;

separating the first anchor region of the elastic band from the first release liner portion;

adhering the first anchor region of the elastic band to the first end segment of the label strap;

separating the second anchor region of the elastic band from the second release liner portion;

adhering the second anchor region of the elastic band to the second end segment of the label strap while the label strap is formed into the loop, wherein the first and second anchor regions of the elastic band are connected with an elastic bridging segment of the elastic band, thereby providing the labeling sleeve assembly;

expanding the labeling sleeve assembly to increase the interior perimeter length of the loop, wherein the expanding stretches the elastic bridging segment of the elastic band;

inserting at least a portion of the article(s) through the loop of the expanded labeling sleeve assembly;

moving the expanded labeling sleeve assembly along the article(s) to the intended placement location; and releasing the positioned labeling sleeve assembly such that the stretched elastic bridging segment partially contracts to a relaxed state, thereby holding the labeling sleeve assembly around the article(s) under elastic tension.

8. The method of claim 7, wherein expanding the labeling sleeve assembly does not stretch the label strap.

9. The method of claim 7, wherein adhering the first anchor region of the elastic band to the first end segment of the label strap occurs while the label strap is formed into the loop.

10. The method of claim 7, wherein expanding the labeling sleeve assembly substantially does not stretch the first anchor region or the second anchor region.

11. The method of claim 7, wherein the label strap includes printed indicia, the method including positioning the indicia to face away from the article so that the indicia are viewable while the labeling sleeve assembly is secured to the article(s).

12. The method of claim 7, wherein forming the label strap into the loop includes overlapping the first and second end segments of the label strap.

13. The method of claim 12, wherein the overlap of the first and second end segments prevents the elastic bridging segment of the elastic band from contacting the secured article(s).

14. The method of claim 7, and further including removing the elastic band from a supply roll of multiple elastic bands.

* * * * *